US006386008B1

(12) United States Patent
Virtanen et al.

(10) Patent No.: US 6,386,008 B1
(45) Date of Patent: May 14, 2002

(54) SHEET FABRICATION CENTER AND METHODS THEREFOR OF OPTIMALLY FABRICATING WORKSHEETS

(75) Inventors: Mika Virtanen, Harma; Jorma Taijonlahti, Yliharma, both of (FI)

(73) Assignee: Lillbacka Jetair OY, Kauhava (FI)

( * ) Notice: Subject to any disclaimer, the term of this patent is extended or adjusted under 35 U.S.C. 154(b) by 0 days.

(21) Appl. No.: 09/785,267

(22) Filed: Feb. 20, 2001

Related U.S. Application Data

(60) Division of application No. 09/174,576, filed on Oct. 19, 1998, which is a continuation-in-part of application No. 09/056,776, filed on Apr. 8, 1998, now Pat. No. 6,021,658.

(51) Int. Cl.[7] ..... B21C 51/00; B21D 55/00

(52) U.S. Cl. ..... 72/19.8; 72/20.1; 72/20.2; 72/21.4

(58) Field of Search ..... 72/19.8, 20.1, 72/20.2, 21.1, 21.4, 452.8, 452.9, 441, 446, 31.11

(56) References Cited

U.S. PATENT DOCUMENTS

| | | | | |
|---|---|---|---|---|
| 3,392,613 A | | 7/1968 | Johns | |
| 3,405,577 A | | 10/1968 | Cousino | |
| 4,592,220 A | * | 6/1986 | Martinez et al. | 72/19.8 |
| 4,936,126 A | * | 6/1990 | Sato | 72/20.1 |
| 4,936,178 A | | 6/1990 | Ebmeyer et al. | |
| 5,020,407 A | | 6/1991 | Brinlee | |
| 5,086,633 A | | 2/1992 | Meyerle | |
| 5,186,037 A | | 2/1993 | Bihler | |
| 5,199,293 A | | 4/1993 | Catti et al. | |
| 5,390,574 A | | 2/1995 | Schorn | |
| 5,478,301 A | | 12/1995 | Takahashi | |
| 5,829,115 A | | 11/1998 | Speller, Jr. et al. | |
| 5,937,694 A | * | 8/1999 | Mueller | 72/452.8 |
| 5,941,110 A | * | 8/1999 | Cao et al. | 72/20.1 |
| 6,112,568 A | * | 9/2000 | Lindstrom | 72/452.9 |

FOREIGN PATENT DOCUMENTS

| | | |
|---|---|---|
| EP | 0 417 836 | 3/1991 |
| GB | 2323318 | 9/1998 |
| JP | 05-71369 | 9/1991 |
| JP | 11-241608 | 12/1997 |
| JP | 2-115537 | 10/1998 |

OTHER PUBLICATIONS

"New servo–driven punch press broadens options for buyers", Sheet Metal Industries, Oct. 1995, pp 14, 16.
Wiedemann Muratec advertisement, 1998.

* cited by examiner

*Primary Examiner*—Ed Tolan
(74) *Attorney, Agent, or Firm*—Louis Woo

(57) ABSTRACT

A sheet fabrication machine is equipped with different servo motors for actuating its upper tool and its lower die. A direction converting mechanism is provided to each of the tool assembly and the die assembly so as to convert the non-vertical forces output by the servo motors into vertical forces that enable the tool and die to move relative to each other to effect work on a workpiece placed therebwtween. The sheet fabrication machine is moreover equipped with a system and logic for automatically measuring the length of the tool and for providing a setting from which the operation of the tool can be referenced. Additional features provisioned into the sheet fabrication machine include look ahead functions for optimizing the operational speed of the machine while minimizing the noise generated as a result of the operation. Also included in the sheet fabrication machine are energy saving features and automatic control of the temperature of the machine to prevent any potential damage thereto due to overheating.

26 Claims, 29 Drawing Sheets

F
10
11
37
1
40
35
30
39
8
9
7
42
41
14
29
32
31
34
44

F
10
11
37
1
40
35
30
39
8
9
7
42
29
32
31
34
14
41

FIG. 9a
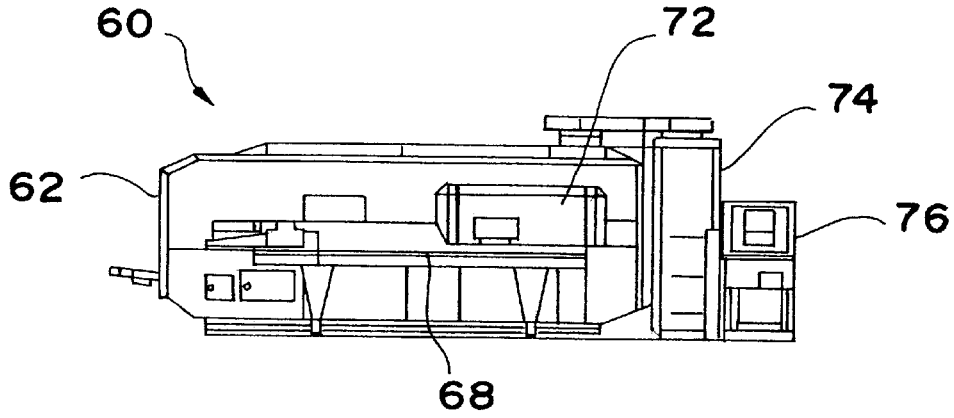
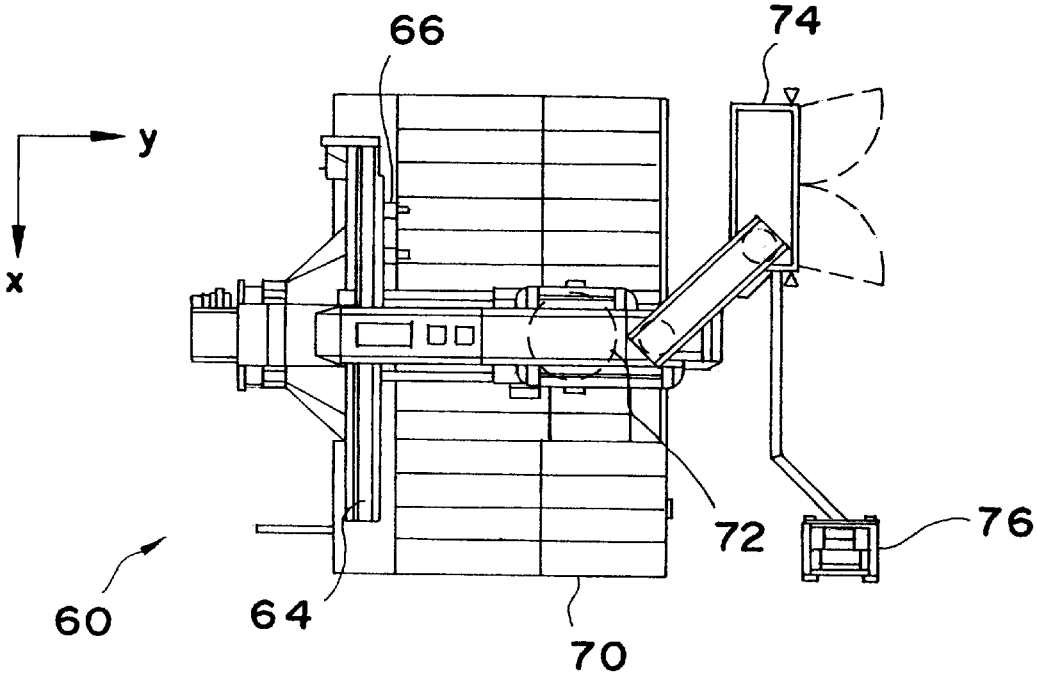
FIG. 9b

FIG. 10a
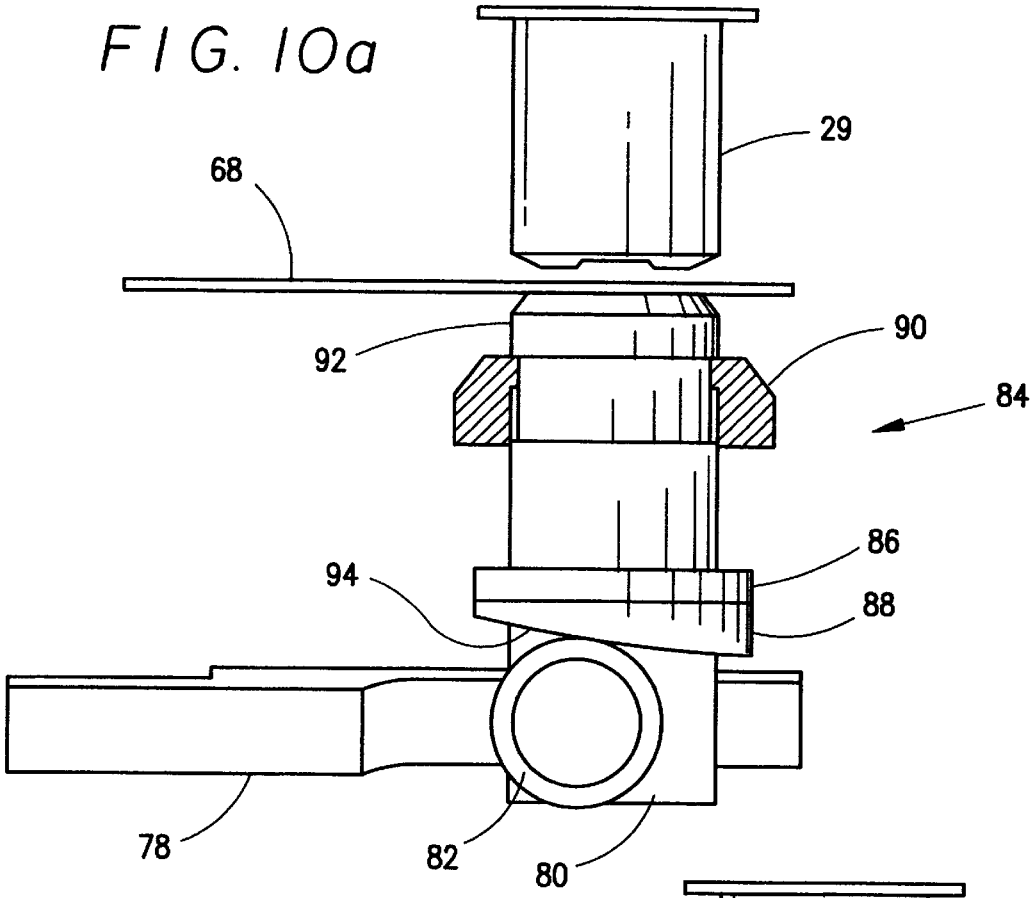
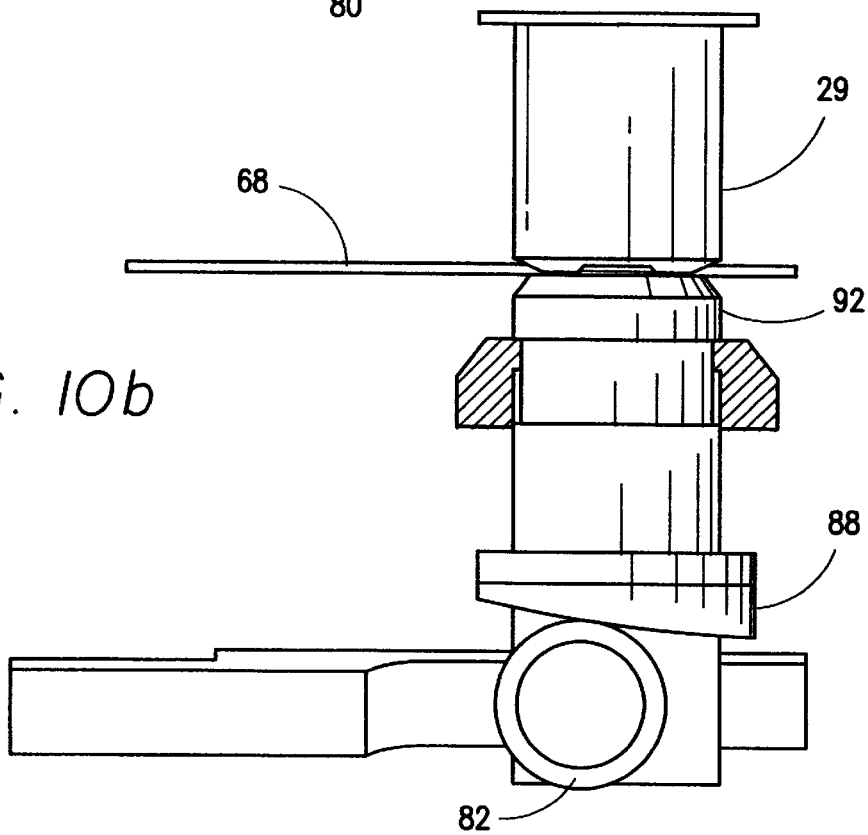
FIG. 10b

Velocity (Worksheet)
140
156
t1
t2
t3
t6
t7
t

Velocity (Ram)
158
t2
t3
t6
t7
t

Position of Ram
142
144
148
68
154
152
t2
t3
t4
t5
t6
t7
t

Force of Ram
146
150
t2
t3
t4
t5
t

FIG. 21a
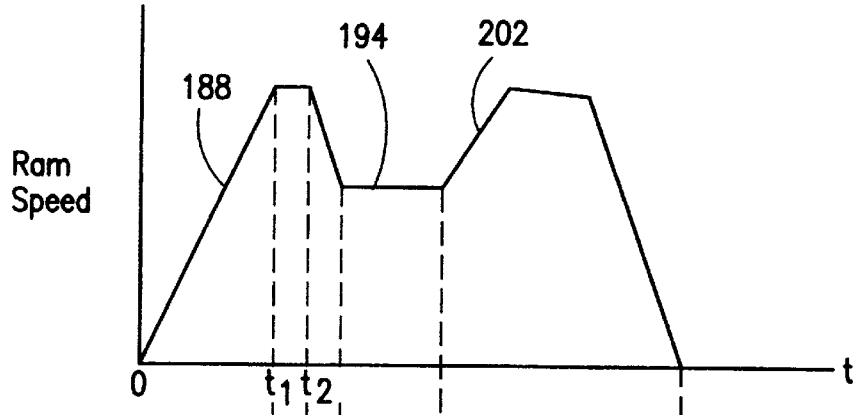
FIG. 21b
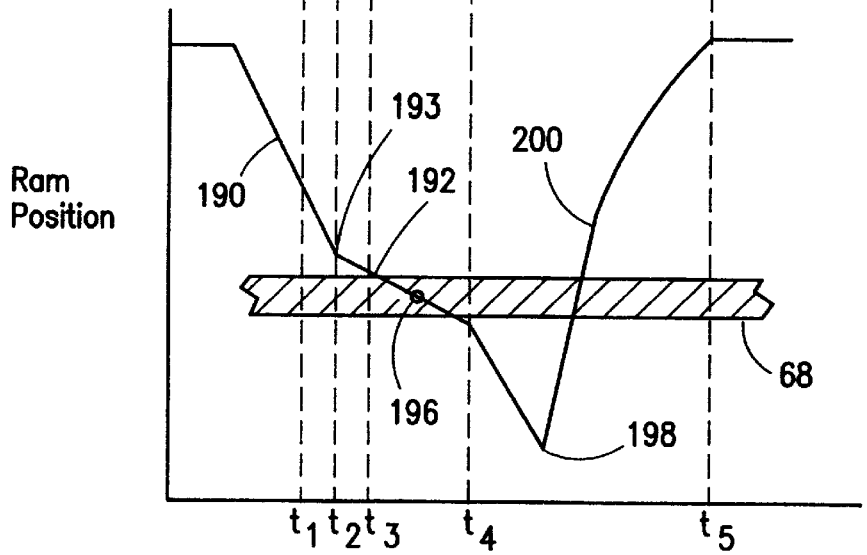
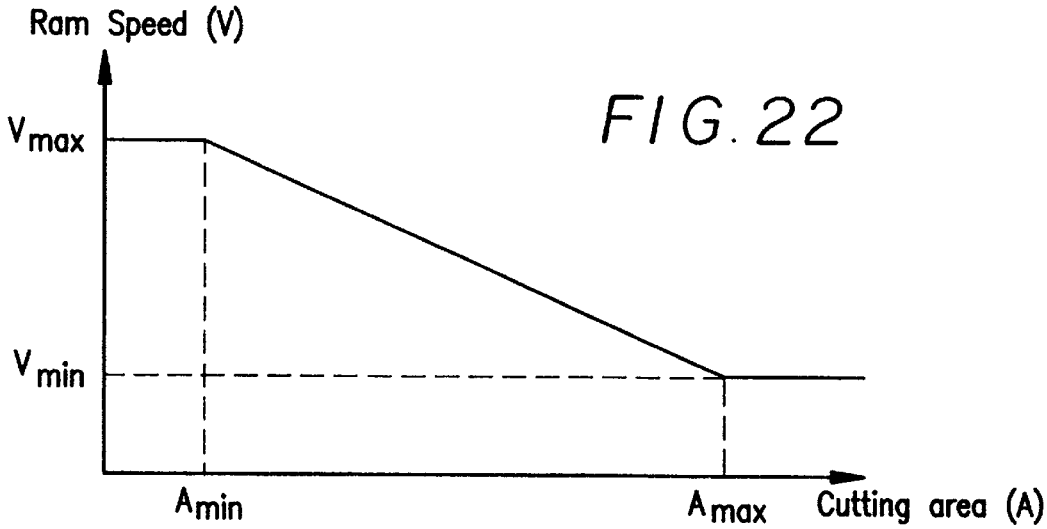
FIG. 22

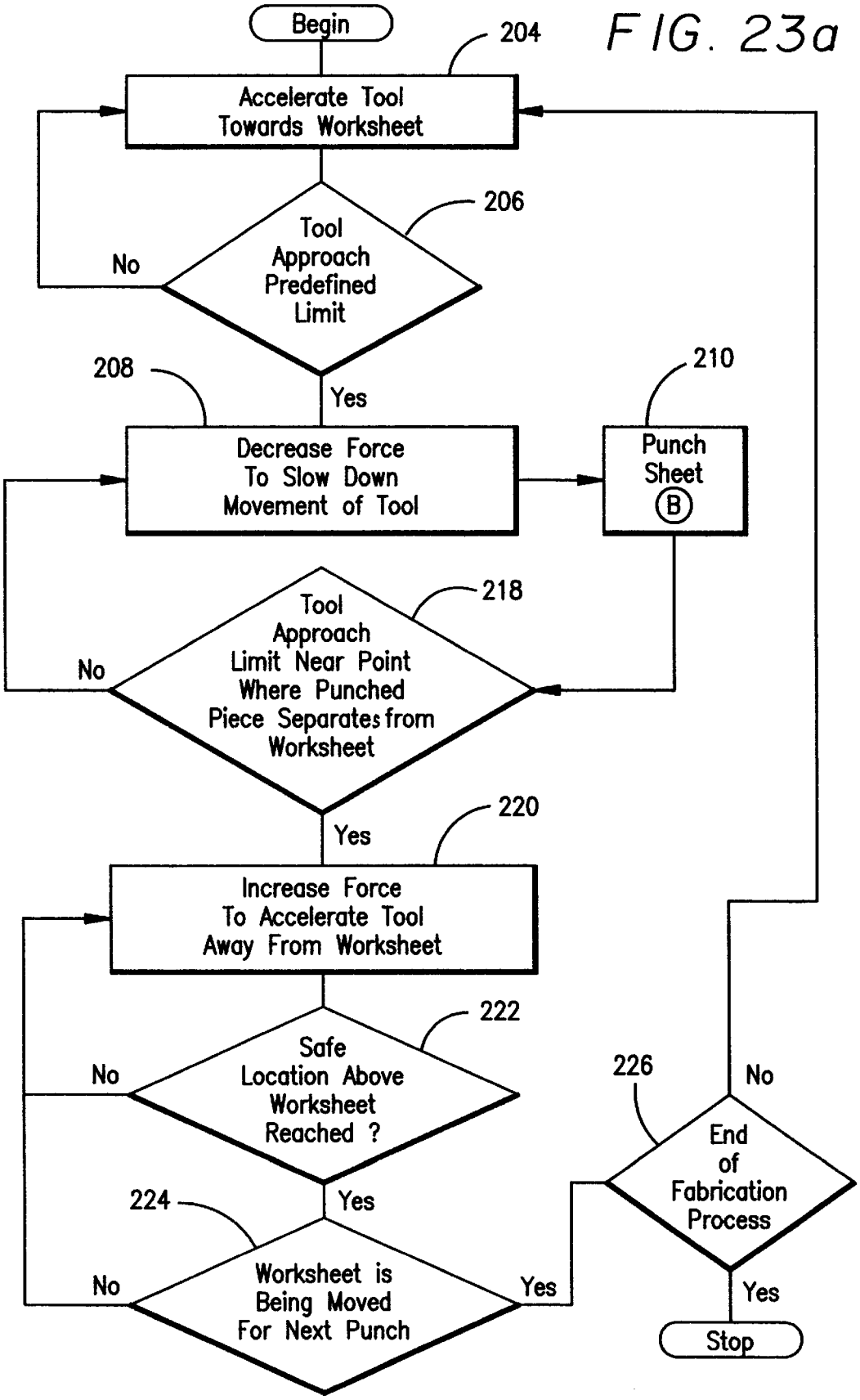
FIG. 23a
Begin
204
Accelerate Tool Towards Worksheet
206
Tool Approach Predefined Limit
No
Yes
208
Decrease Force To Slow Down Movement of Tool
210
Punch Sheet
B
218
Tool Approach Limit Near Point Where Punched Piece Separates from Worksheet
No
Yes
220
Increase Force To Accelerate Tool Away From Worksheet
222
Safe Location Above Worksheet Reached ?
No
Yes
224
Worksheet is Being Moved For Next Punch
No
Yes
226
End of Fabrication Process
No
Yes
Stop FIG. 28a
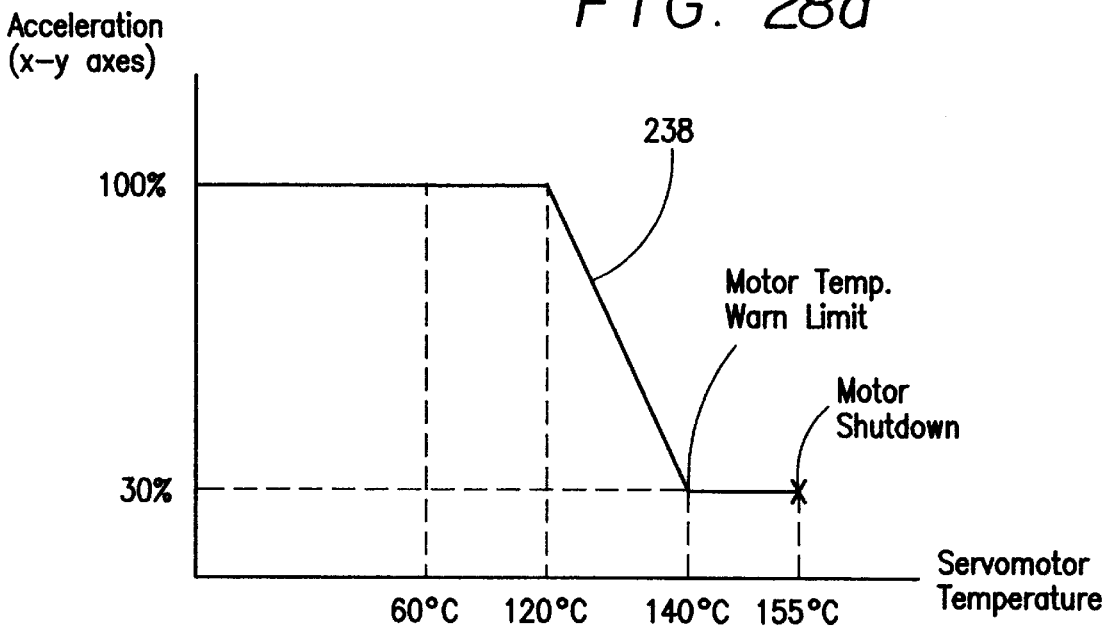
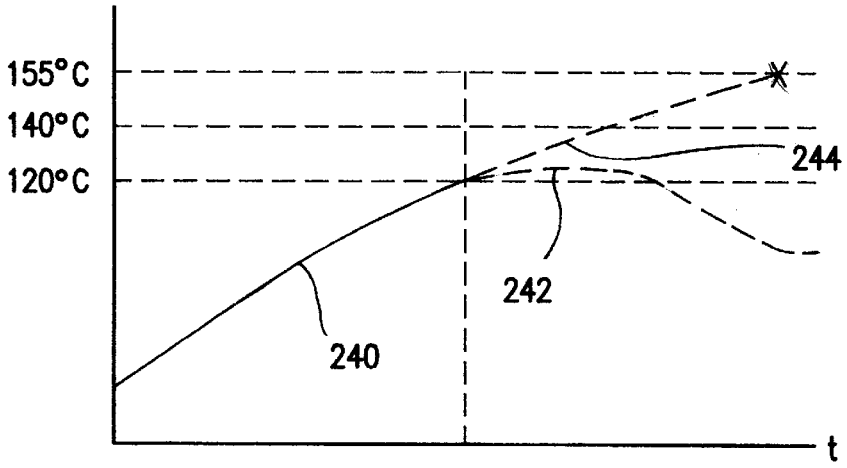
FIG. 28b

SHEET FABRICATION CENTER AND METHODS THEREFOR OF OPTIMALLY FABRICATING WORKSHEETS

This application is a divisional of Ser. No. 09/174,576 filed Oct. 19, 1998 is a Continuation in Part of Ser. No. 09/056,776 filed Apr. 8, 1998 which now U.S. Pat. No. 6,021,658.

FIELD OF THE INVENTION

The present invention relates to sheet fabrication centers and machines such as for example turret punch presses, and more particularly to a new generation sheet fabricating machine that utilizes servo motors as its driver mechanisms for optimally effecting work on worksheets with less noise.

BACKGROUND OF INVENTION

Publications U.S. Pat. No. 5,092,151 and U.S. Pat. No. 5,199,293 disclose particularly sheet working centers intended for bending, whereby separate means are used for accomplishing the approaching movement of the tool on one hand, and the actual working movement on the other hand. The means for accomplishing the approaching movement to the tool are constructed in a way that the approaching movement is relatively quick, and on the other hand, the means for accomplishing the actual working movement are constructed in a way that their movement is relatively slow in relation to the movement of the first means. On the other hand, the second means are constructed so that the force effect to be accomplished with them is considerably greater for the working of the sheet than the force effect accomplished by the movement of the first means which accomplish only a linear movement.

In said US publication, the second means comprise a first gliding means fixed to a buffer arranged to be movable in the vertical direction, and a second gliding means arranged to move by actuators in the horizontal direction, wherein the working movement of the second means is accomplished by a wedging effect between the first and second gliding means. Between the wedge surfaces in the first and second gliding means, there are roll surfaces, by means of which the movement of the horizontally moving, wedge-like second gliding means is transmitted to the second gliding means as a vertical movement and thus to the working movement of the tool in the buffer bar.

The solution known from the publications U.S. Pat. No. 5,092,151 and U.S. Pat. No. 5,199,293 is disadvantageous in the respect that the approaching movement and the working movement are arranged to be effected by separate means and actuators using them. In consequence, firstly the construction using such a method is complex and expensive, because of the high investments on the required equipment; second, a complex control, system is required for the successive approaching and working movements, which may easily cause operational risks.

SUMMARY OF INVENTION

It is an aim of the present invention to eliminate the above-mentioned disadvantages of prior art and thus to improve the level of technology in the field.

More particularly, the instant invention sheet fabrication machine is a new generation machine that, instead of hydraulics, utilizes servo motors for activating the sheet fabrication mechanisms, such as for example the coacting tool and die for effecting work on a worksheet. To provide movement for the upper tool, a servo motor with sufficient torque drives a contact mechanism, in the form of a roller, for example, moveable along the direction parallel to the plane of the worksheet, referenced simply as the x axis, for example. The top of the ram to which the roller makes contact is configured such that when the roller is driven by the servo motor to move to a given position along the x axis, the ram is driven in a vertical direction for a given distance. The configuration of the top portion of the ram, which together with the tool may simply be referred to as the tool means, is particularly configured to have at least one surface that, when it comes into contact with the roller, would actuate the tool to perform a number of innovative techniques, among which include, but not limited to, the punching of a worksheet, the measurement of the tool length, the presetting of a base point from which the work of the tool is referenced, and a forming operation on the worksheet.

The instant invention sheet fabrication machine also utilizes a servo motor for effecting the movement of the lower die, in a vertical direction relative to its corresponding upper tool. The mechanism for effecting the vertical movement of the die could be similar to that which effects the vertical movement of the upper tool, as the lower portion of the die is configured such that when the lower contact means, for example a roller, driven by the lower servo motor makes contact with the bottom portion of the die, vertical movement of the die is effected. Some of the configurations envisioned for the bottom portion of the die include the use of a wedge, a ring and a threaded portion all of which can coact with the servo motor, and its appropriate driving mechanism. Equivalents of the just mentioned configurations are also envisioned.

In addition to being able to measure the length of the tool and providing a setting from which the tool can reference its work, the present invention machine further includes software programmed thereto that provides logic that enables it to inform the operator that the punch tool within the tool assembly needs to be readjusted. Other logic features of the instant invention machine include "look ahead" functions that enable the machine to simultaneously accelerate and decelerate the tool and the worksheet so that optimal fabrication of the worksheet can take place. Further logics are provided to minimize the. noise that results from the tool coming into contact with the worksheet. With the appropriate logic and the proper configuration of hardware, deforming operation can also be performed by the lower die with great accuracy and no marking of the worksheet, as compared to when the worksheet is formed by the use of an upper tool.

Given that both the working tool and die each are driven by a servo motor, the instant invention machine, unlike the conventional hydraulics driven machines, can control the accuracy of how the sheet is worked to a much greater degree.

In addition to being provisioned with the appropriate software and hardware to optimize the operational speed and minimize the noise generated, the instant invention machine is also provisioned with an energy conservation system that enables the reuse or recycling of excess energy generated to thereby reduce its energy consumption. The instant invention machine furthermore is provisioned with a temperature maintenance system that monitors the operating temperature of the machine, and more specifically the various servo motors thereof, so as to ensure that the operating temperature of the machine does not exceed a predetermined overheating temperature for a predefined period of time, thereby preventing detriment to the machine.

The instant invention therefore provides an economical as well as ecologically friendly machine for sheet fabrication.

The instant invention further provides a machine that is capable of effecting different types of operations on worksheets by using servo motor driving mechanisms.

It is furthermore an objective of the present invention to provide a sheet fabrication machine that has the intelligence to "look ahead" in its fabrication of a worksheet so that the acceleration/deceleration of both the worksheet and the tool for effecting work on the worksheet are optimized.

It is moreover an objective of the present invention that the noise level resulting from the operation of the machine be minimized, as for example limiting the decibel (dB) of the noise of the machine to certain predefined limits.

BRIEF DESCRIPTION OF THE DRAWINGS

The above-mentioned objectives and advantages of the present invention will become apparent and the invention itself will best be understood by reference to the following description of the instant invention taken in conjunction with the accompanying drawings, wherein:

FIGS. 9*a* and 9*b* are respective cross view and top view of the sheet fabrication machine of the instant invention that has incorporated thereinto the tool fabrication mechanism illustrated in FIGS. 4 and 5;

FIGS. 10*a* to 10*e* illustrate an up forming operation by the die assembly of the sheet fabrication machine of the instant invention;

FIGS. 21*a* and 21*b* illustrate the speed and position of the ram with respect to the intelligent noise reduction aspect of the machine of the instant invention;

FIG. 22 is a diagram illustrating the relationship between the speed of the ram and the cutting area of the tool, and its relationship to the noise reduction aspect of the machine of the instant invention;

FIG. 23*a* and 23*b*, in combination, provide a flow chart that illustrates the steps for accelerating and decelerating the movement of the tool and worksheet for optimizing the respective operational speeds of the sheet and tool, as well as minimizing the noise generated from the operation for the machine of the instant invention;

FIGS. 28*a* and 28*b* are graphs illustrating the monitoring of the temperature of the machine and the control of the speed of the servo motors in the machine in response to the monitored temperature condition of the machine.

DETAILED DESCRIPTION OF THE INVENTION

Figure 1A:
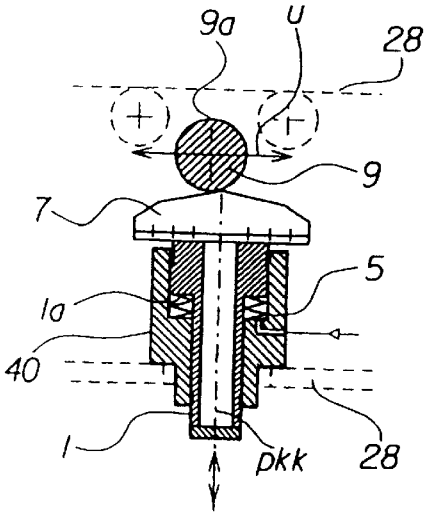
FIGS. 1*a–c* to 3*a–c* are illustrations of three advantageous exemplar implementations of the top portion of the ram, and the corresponding power/time diagrams, of the instant. invention machine.
Figure 1B:
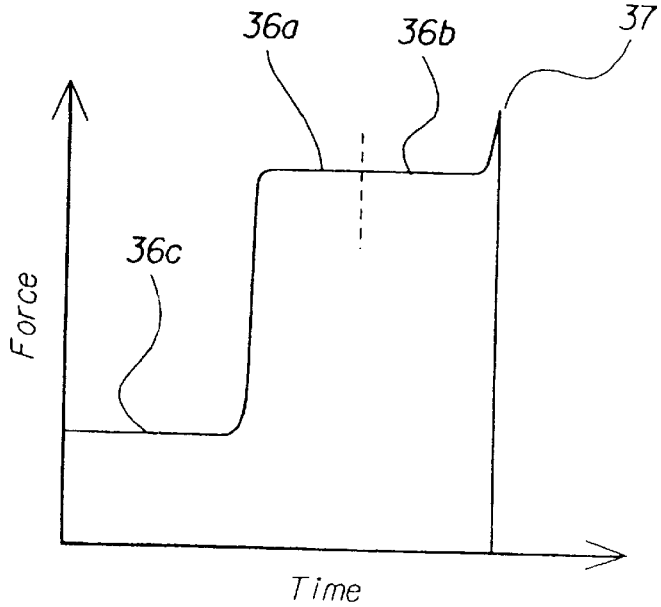
Figure 1C:
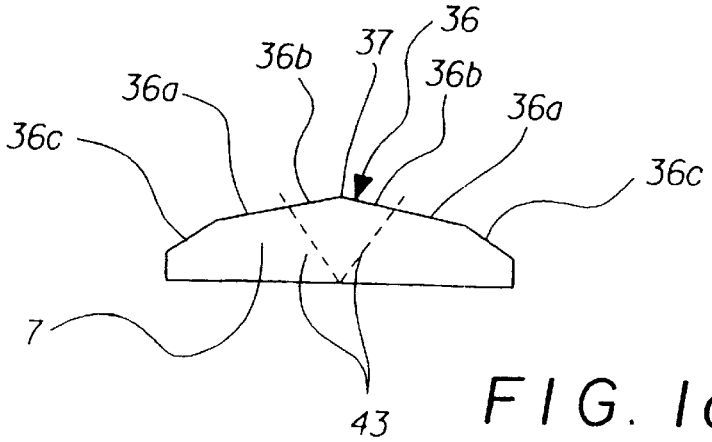

With reference to FIGS. 1 to 3, a machine body 28 is provided with a buffer bar or ram 1 to move in the vertical direction in a cylindrical clamp or cylinder 40 in the machine body. A pneumatic chamber 5, possibly equipped with a spring, is effective between the front surface la of a flange in connection with the buffer bar 1 and the machine body 28, for accomplishing the return movements of the buffer bar. The top part of the buffer bar 1 is equipped with means 7, 9 for accomplishing the movements of the buffer bar 1 and the tool in a power transmission connection with the same in a direction that is substantially perpendicular to the level of the die (FIG. 4). The first part 7 of the means, which may be referred to as the cam of the, ram, is fixed to the top part of the buffer bar 1. The, second part 9 of the means, which may be a rotatable mechanism such as for example a roller that acts as a contact means with first part 7, is fixed to. the machine body 28 to be movable in relation to the same by using actuators in the machine body 28.

According to the method, the movement of the second part 9 of the means 7, 9 in relation to the machine body 28 is transmitted from the second part 9 through a contact means or contact surface connection, which may be a cam with a particular configuration, to the movement of the buffer bar 1 in connection with the first part 7 and the tool 29 attached to the same—both as the approaching and the working movement. Either the first part 7 or the second part 9 or both are equipped with a contact surface part 36 which is formed as a substantially beveled surface in relation to the longitudinal direction of the buffer bar 1.

It is common to all the embodiments of FIGS. 1 to 3 that the guide surface part 36 is provided with at least a first portion 36*a* for accomplishing the transfer movements of the buffer bar and the tool fixed therewith, and a second portion 36*b* for accomplishing the working movements of the buffer bar 1 and the tool 29 in a power transmission connection therewith on a worksheet or workpiece 32.

In the embodiment of FIG. 1, the first part 7 is arranged as a shaper plate or cam comprising the guide surface part 36 and placed in the machine body 28 parallel to the linear movement (arrow LL) of the roll-like second means so that the first portion 36*a*, second portion 36*b* and also third portion 36*c* of the guide surface part, where the buffer bar 1 is in the tool exchange position, are successive in the direction of the linear movement LL. The second part 9 is formed as at least one rolling means, preferably a roller whose peripheral surface 9*a* is in a contact surface connection with the guide surface part 36 of the first part 7. The-linear movement LL of the second part 9 during application of the method is advantageously directed perpendicular to the longitudinal and movement direction of the buffer bar 1.

In the embodiment of FIG. 1, the guide surface part of the first part 7 is formed symmetrical and equiform, and equidistance, in relation to the end point between the halves of the guide surface part 36, i.e. in this case the inversion or apex point 37. The inversion point 37 is placed on the central line PKK in the longitudinal direction of the buffer bar 1., wherein said inversion point determines the terminal point of the working movement of the tool when applying the method.

In the embodiments of FIGS. 2 and 3, in difference to the embodiment of FIG. 1, the movement of the second part 9 is arranged as a rotational movement around an axis A.

Figure 2A:
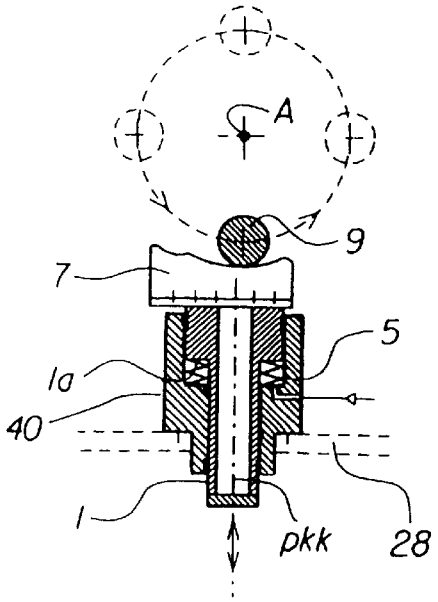
Figure 2B:
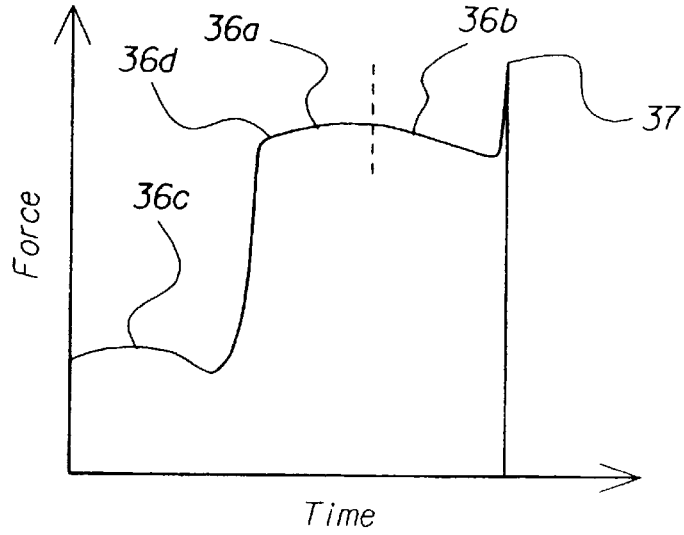
Figure 2C:
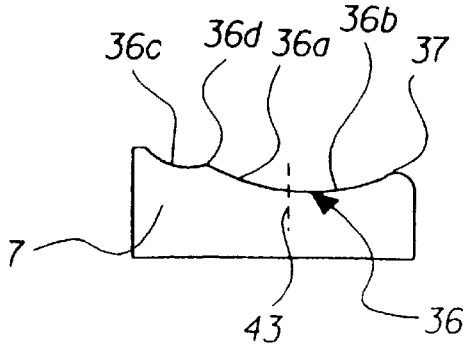

In the embodiment of FIGS. 2*a–c*, the longitudinal direction of the central line of the rotational movement of the second part 9 is placed in an inclined or preferably perpendicular position in relation to the longitudinal direction of the central line PKK of the buffer bar 1. Thus, the guide surface part 36 in connection with the shaper or cam plate forming the first part 7 in connection with the buffer bar 1 is shaped as a curved, particularly circular surface. Further, in the direction of the circumference of the rotational movement of the second part 9, there may be two or more rolling means, preferably rollers, arranged in succession to accomplish a contact surface connection with the guide surface part 36 of the first part 7. The rollers are mounted on bearings in a body frame rotating around the axis A so that their rotation axis is parallel to the axis A. The curved guide surface part 36 (FIG. 2*c*) is formed as a longitudinal curved surface whose longitudinal direction is aligned with:the plane of the rotational movement of the second part 9 so that the first portion 36*a* of the curved shape extends at the beginning of the curved form and the second portion 36*b* extends from the bottom of the curved form to the terminal point 37 of the curved form where the rolling means 9 is disengaged from the guide surface part 36. The third portion 36*c* of the guide surface part 36 extends as a separate curved form in extension to the portions 36*a* and 36*b*, wherein the second part 9 is placed in the upper position of the buffer part 1 in a contact surface connection with the third portion 36*c* during a tool exchange. When starting the transfer movement of the buffer bar 1 after a tool exchange, the second part 9 moves from the third portion 36*c* to the first portion 36*a* of the guide surface part 36 over a beak 36*d* placed between the third portion 36*c* and the first part 36*a* of the left guide. surface part in the embodiment of FIG. 2*a–c*. FIG. 2*c* shows further the division of the guide surface part 36 into the portions 36*a* and 36*b* by a broken line 43.

Figure 3A:
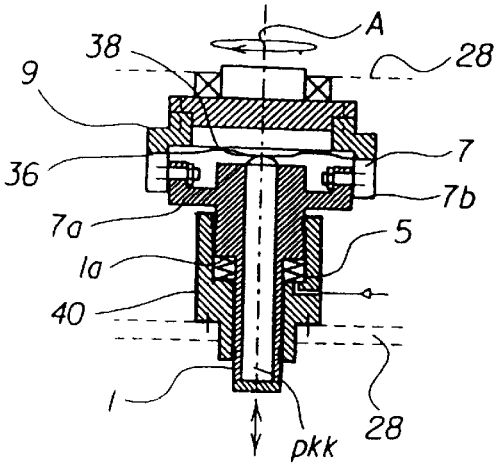
Figure 3B:
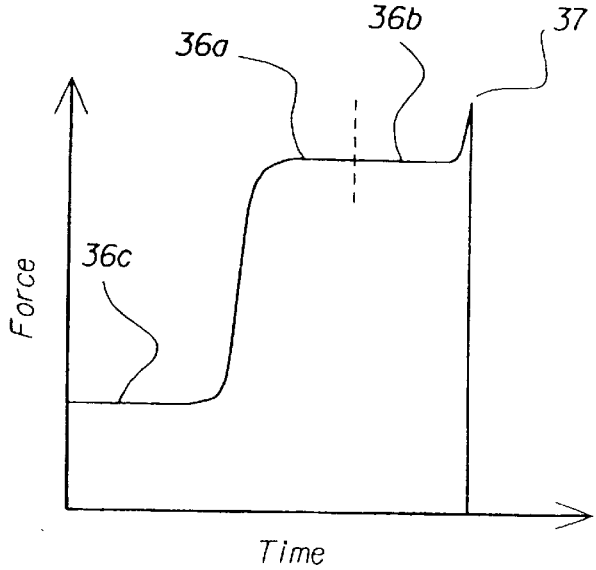
Figure 3C:
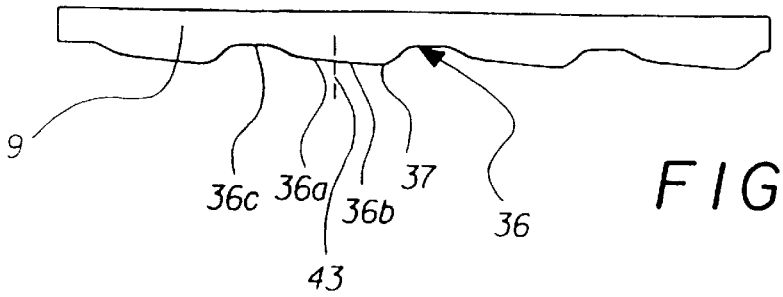
Figure 4:
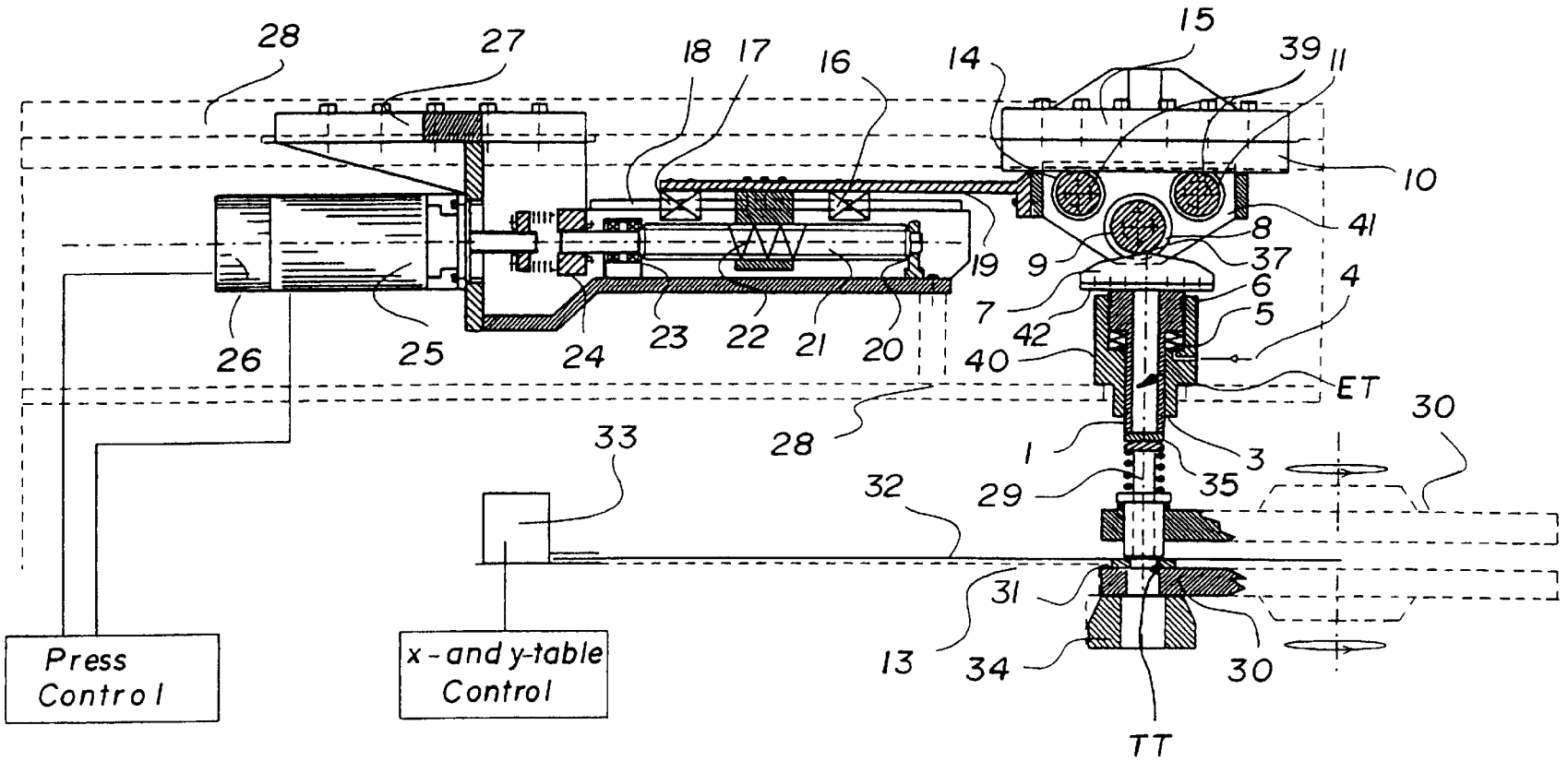
FIG. 4 shows a detailed apparatus application of an exemplar driving mechanism of the instant invention.

FIGS. 3*a–c* show an embodiment of the method according to the invention where, contrary to the embodiments above, the central line A of the rotational movement of the second part 9 is placed in alignment and to unite with the longitudinal central line PKK of the buffer bar 1. Thus, it is possible to place the rolling means, e.g. rolls or rollers, forming the first part 7 of the means 7, 9, in connection with the buffer bar 1, mounted on bearings on the circular frame body 7*a* fixed to the buffer bar 1, wherein the rolling means forming the first part 7 rotate, supported by the frame body 7*a*, in the horizontal plane around radial axes 7*a*. In a corresponding manner, the guide surface part 36 (FIG. 3*c*) is formed in connection with the second part 9, wherein it comprises the shape of a circle or ring with two or more zones 38 which are each substantially equal in shape and in which the portions 36~6*c* are placed so that each rolling means forming the first part 7 and rotating when supported by the frame body 7*a* are at the same stage of contact surface connection. FIG. 3*c* shows, displayed in a plane, the guide surface 36, wherein a broken line 43 indicates the point of change between the portions 36*a* and 36*b* in the inclined portion of the guide surface 36. The portion 36*c* consists of an indentation in the guide surface 36.

FIGS. 1*b* to 3*b* show further the time/force curves formed in connection with the corresponding embodiments, and the corresponding portions of the guide surface part 36 particularly in the cutting machining embodiment.

With reference to FIGS. 4 to 7, the apparatus assembly used in the method of the invention and applied in the sheet machining center or sheet fabrication machine such as for example a turret punch machine operates in the following way. The sheet 32 to be worked that is fixed by normal clamping jaws to be transferred in the X,Y direction on a horizontal working table, plane or surface 13, is placed in the desired position on the working surface 13 for machining operations by means of an X,Y transfer device 33, such as for example a servo motor, in connection with the clamping jaws. The working surface 13 is equipped with a die 31 which is substantially on the same plane or slightly upwards protruding above a lower stop 34 and on top of which the area of the sheet to be worked, i.e. cut, marked, and/or molded, is placed. Above the die 31, on the opposite side of the sheet 32, there is a tool 29 which is, in the same way as the die 31, fixed to a rotating tool revolver or turret 30 (shown by broken lines). The tools 29 and corresponding dies in the tool revolver 30 can be exchanged by turning the tool revolver 30 to the end 35 of the buffer bar 1 and the lower stop 34. The buffer bar or ram 1 is an elongated form piece with a circular cross-section, fixed to the cylindrical clamp or cylinder 40 of the buffer bar 1 in connection with the machine body 28, to be movable in the direction of its longitudinal axis. A sliding bearing system 3, 6 is effective between the cylindrical clamp 40 of the buffer bar 1 and the outer surface of the buffer bar. Ram 1, its cylinder and bearing system in combination, may be referred to as the ram assembly.

In the expanded top part or portion of the buffer bar 1, above the buffer bar 1 is fixed the first part 7 of the means 7, 9 which is, in the embodiment (see also FIG. 1) a vertically positioned elongated plate-like form or cam piece whose upper edge is formed as the guide surface part 36. The first part 7 is thus placed in the top part of the buffer bar 1 so that the guide surface part 36 of its upper edge is parallel with the direction of the linear movement of the second part 9 of the means 7, 9. For the instant invention, not to be limiting, cam 7 in combination with buffer bar 1 and its cylindrical clamp 40, as well as tool 29, may be referred to simply as the tool means or punch means.

Figure 5:
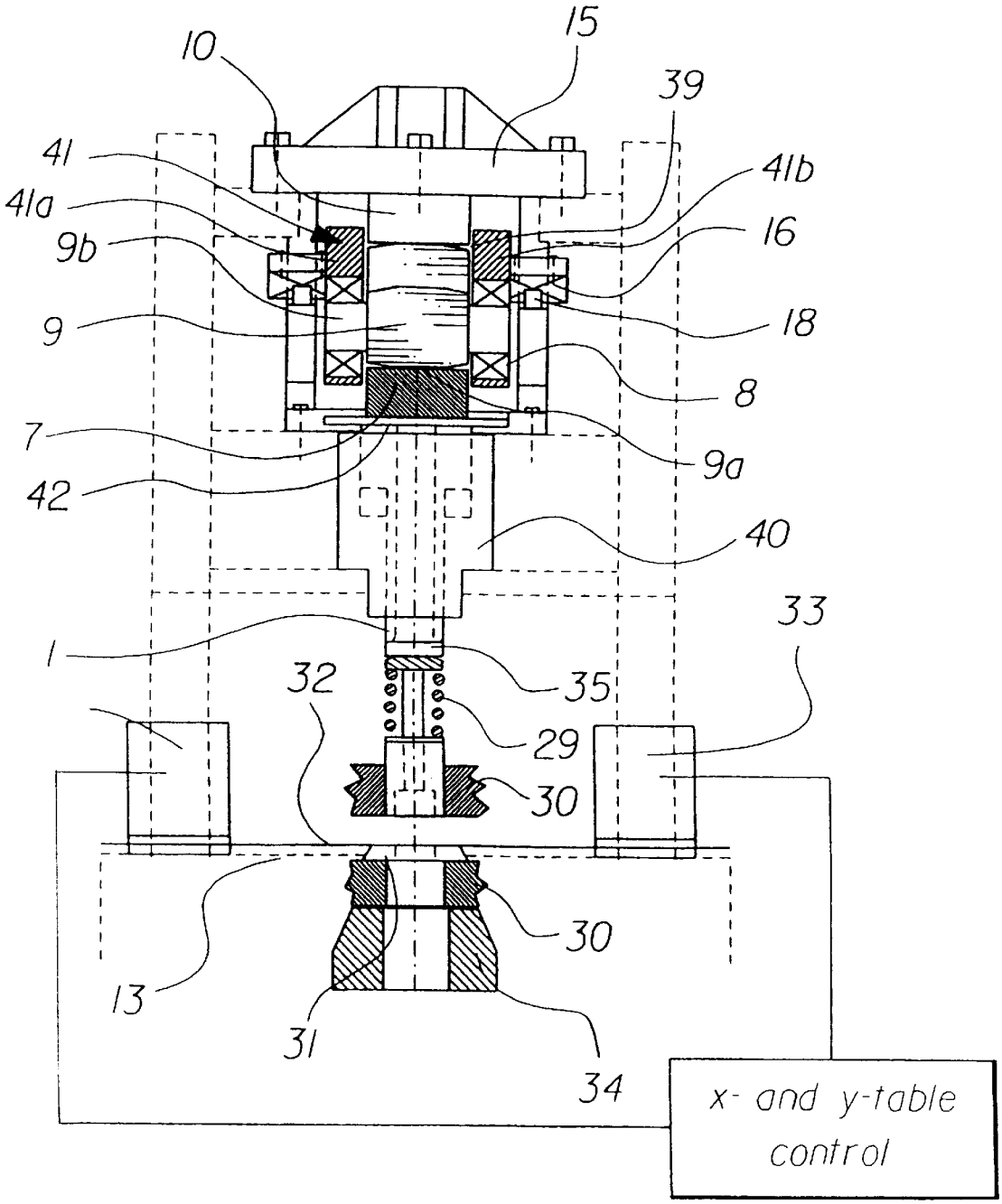
FIG. 5 shows the apparatus of FIG. 4 seen from the end.

The outer surface 9*a* of the second part 9 is in a contact surface connection with the guide surface part 36 of the first part 7. The second part 9 is mounted on bearings in an auxiliary body 41 mounted in the machine body 28. The roll-like second part 9 comprises an axle part 9*b* (see FIG. 5) which is mounted on bearings in the plate-like elements 41*a*, 41*b* of the auxiliary body on both sides of the second part 9. The auxiliary body 41 is also equipped with rolling means 39 separate from the second part 9. In the presented embodiment, there are two rolling means 39 placed horizontally on opposite sides of the second part 9, seen from the side direction of FIG. 4, at such a height position in connection with the auxiliary body 41 that the outer peripheries of the rolling means 39 are in a contact surface connection with a stop beam 10 belonging to a guiding device in connection with the auxiliary body 41, the top thereof. The stop beam 10 is linear, wherein the auxiliary body 41 conducts a linear movement that is transmitted to a linear movement of the second part 9, the second part 9 rolling in a contact surface connection with the guide surface part 36 during the movements of the buffer bar 1. In FIG. 5, the reference numeral 8 indicates the rolling bearings of the second part 9 by which said elements are mounted on bearings with the auxiliary body 41. Further, the auxiliary body unit 41 comprises a stop body 15 belonging to a guiding device and fixed above the stop beam 10 in the machine body 28, the stop beam 10 being fixed to the stop body 15 e.g. by a bolted joint. As mentioned above, the auxiliary body 41 is fixed to the machine body 28 to be movable in relation to the same. In FIGS. 4 and 5, the machine body 28 is shown by broken lines for better illustration.

To one vertical end of the auxiliary body 41 is fixed a horizontal transfer bar 19 of the linear guide arrangement, to which are fixed transfer carriages 16,17 of the linear guide arrangement, which, in turn, are connected to a linear guide 18. Auxiliary body 41 accordingly is movable in a bidirectional translational fashion. The transfer body 27 mounted to the auxiliary body 28 is provided with a ball screw shaft 21 with bearings 20 and 23 at the ends of the screw shaft. A nut arrangement 22 is placed on the outer periphery of the screw, the nut being in turn fixed to the transfer bar 19 in a stationary manner. To the free end of the screw shaft 21 (on the left in FIG. 4) is fixed via an overload switch 24 a servo motor or servo mechanism means 25, which is also fixed to the transfer body 27 mounted on the machine body 28. In connection with the servo motor 25, there is a pulse sensor or encoder 26, wherein both the pulse sensor 26 and the servo motor 25 are coupled to the control system or central numerical control (CNC) 43 of the sheet machining center. With such configuration, roller 9 can be driven by servo motor 25 so as. to effect bidirectional translational movements.

Figures 6A, 6B, 6C, 6D:
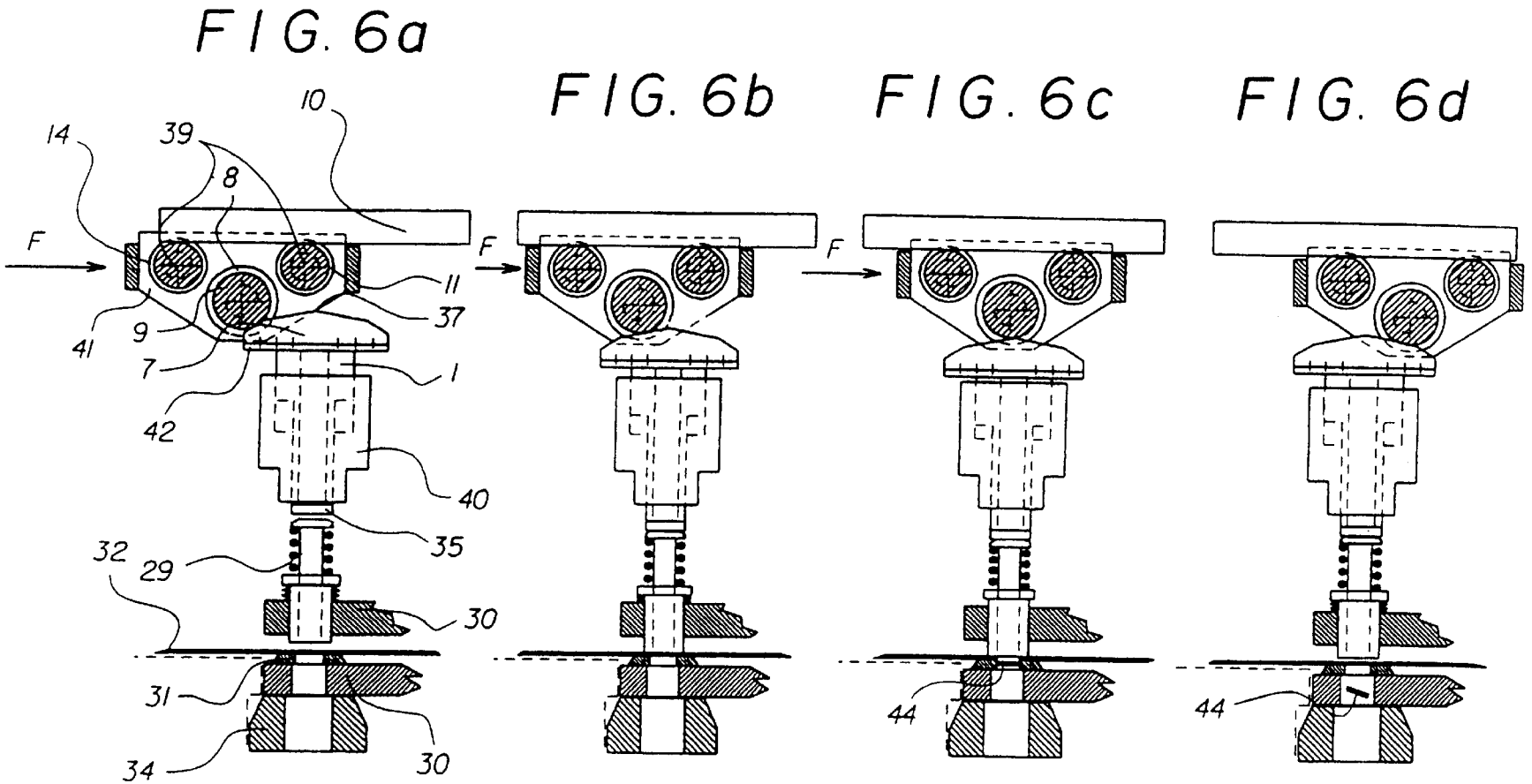
FIG. 6 shows different steps a to d of the method implemented with the embodiment according to FIGS. 1, 4 and 5 in cutting work.

Further, FIGS. 6*a–d* illustrate more closely details of the embodiment of FIGS. 1, 4 and 5 in the cutting machining application. FIG. 6*a* shows a tool exchange center where the second part 9 of the means 7, 9 is placed at the third portion 36*c* of the guide surface part 36, wherein the tool revolver 30 exchanges the tool 29, whereafter the buffer bar 1 is fixed by means 35 to the tool 29. In FIG. 6*b*, the linear movement of the second part 9 has advanced to a stage where the transfer or approaching movement of the tool 29 by the contact surface connection is completed in the area of the first portion 36*a* of the guide surface part. FIG. 6*c* shows a punching movement, wherein a waste piece 44 detached in the punching movement is pushed by the final stage of the punching movement inside the die 31. Thus, the second part 9 of the means 7, 9 has, at the final stage of the working movement, already passed the inversion point 37. FIG. 6*d*, in turn, shows the initial position of a new approaching and working movement, i.e. a sheet transfer position, wherein after completion of the previous working stage, the sheet 32 is moved by an X,Y transfer device 33 to a new working position. The second part 9 is thus placed at the end of the first part 36*a* of the guide surface part 36, which is in connection with the third portion 36*c* of the guide surface part. The position of the second part 9 on the first portion 36*a* can naturally be selected according to the thickness of the sheet 32.

Figures 7A, 7B, 7C:
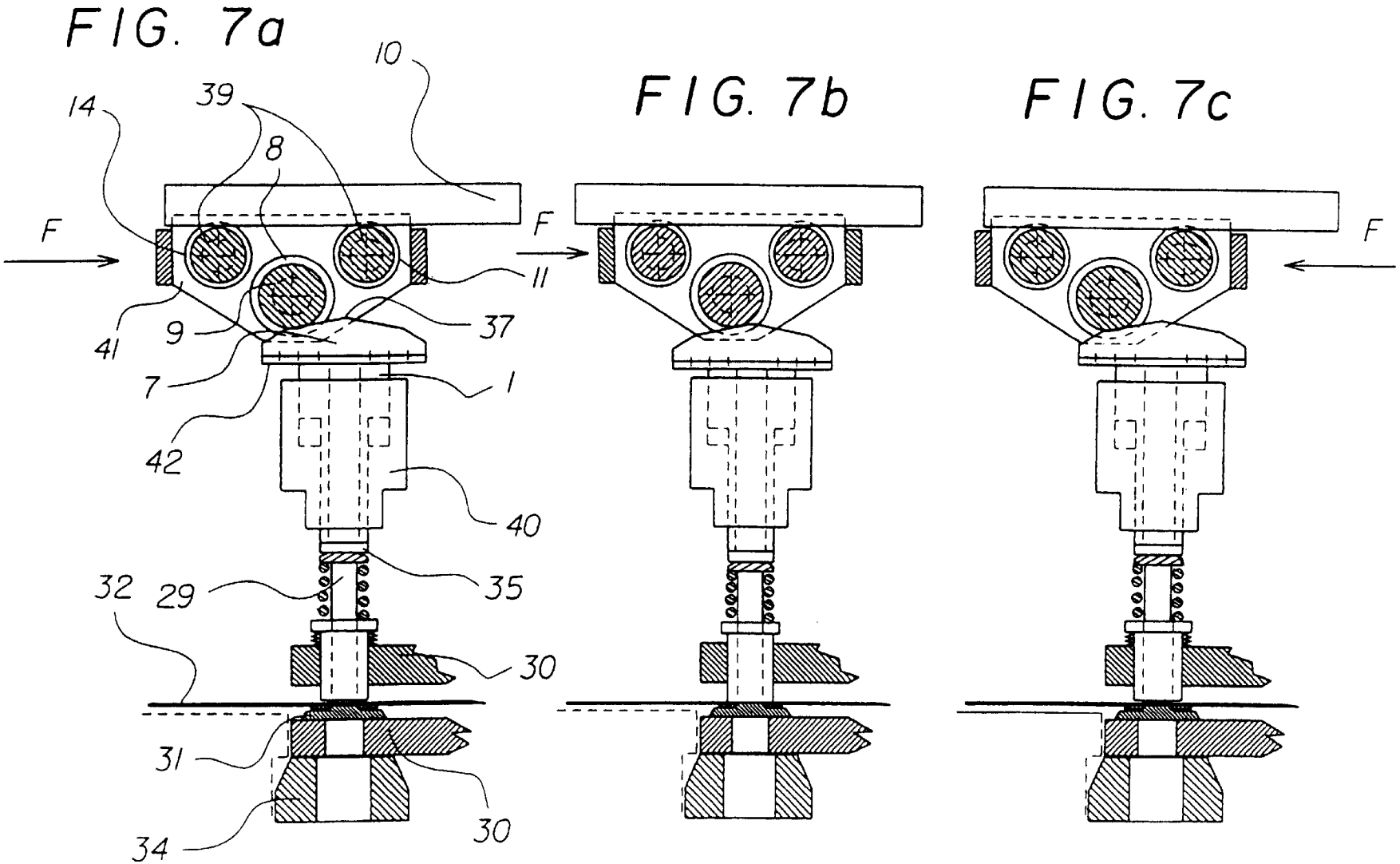
FIG. 7 shows different steps a to C of the method implemented with the embodiment according to FIGS. 1, 4 and 5 in molding, forming or marking work.

FIGS. 7*a–c* shows a molding application with the apparatus of FIG. 6, wherein the second part 9 moves back and forth on the portions 36*a* and 36*b* of the guide surface part 36 and thus does not exceed the inversion point 37 (cf. FIG. 1*b*). FIG. 7*a* shows the initial stage of molding machining, where the sheet 32 is molded against the die 31, and FIG. 7*c* shows a sheet transfer position corresponding substantially to the situation of FIG. 7*a*.

Consequently, the method of the invention can be applied in all methods intended for machining of a sheet, such as edging, bending, punching, and molding, where working is conducted by pressing. Thus, at the general level that is obvious to a man skilled in the art, it can be mentioned that a working machine comprises a first ET and a second TT (cf. FIG. 4), particularly upper and lower machining means in the machine body 28, at least the first one ET being arranged to move in relation to the machine body 28 towards the second one TT, to accomplish machining of a sheet material based on the utilization of a pressing force, wherein the sheet material to be worked is placed between the machining means ET and TT. Thus, at least one of the machining means ET and TT is provided with means 7, 9 for conducting the transfer and working movements of said tool ET, TT. The first part 7 of the means is fixed to the machining means ET and/or IT, and the second part 9 of the means is fixed to the machine body 28, to be movable in relation thereto by actuators 10,11,14–26, 39, 41 in the machine body (the reference numerals 11 and 14 refer to the rolling bearings of the rolls 39). The movement of the second part 9 of the means 7, 9 in relation to the machine body 28 during machining based on pressing of the sheet material is transmitted from the second part 9. to the first part 7 by a contact surface connection. The first part 7 and/or the second part 9 of the means 7, 9 is equipped with at least one guide surface part 36 which is formed as a beveled surface in relation to the direction of movement of the machining means ET, TT. The position of the contact surface connection between the first part 7 and the second part 9 of the means in relation to the guide surface part 36 will define the position of the machining means ET and/or TT in to the machine body 28.

Figure 8:
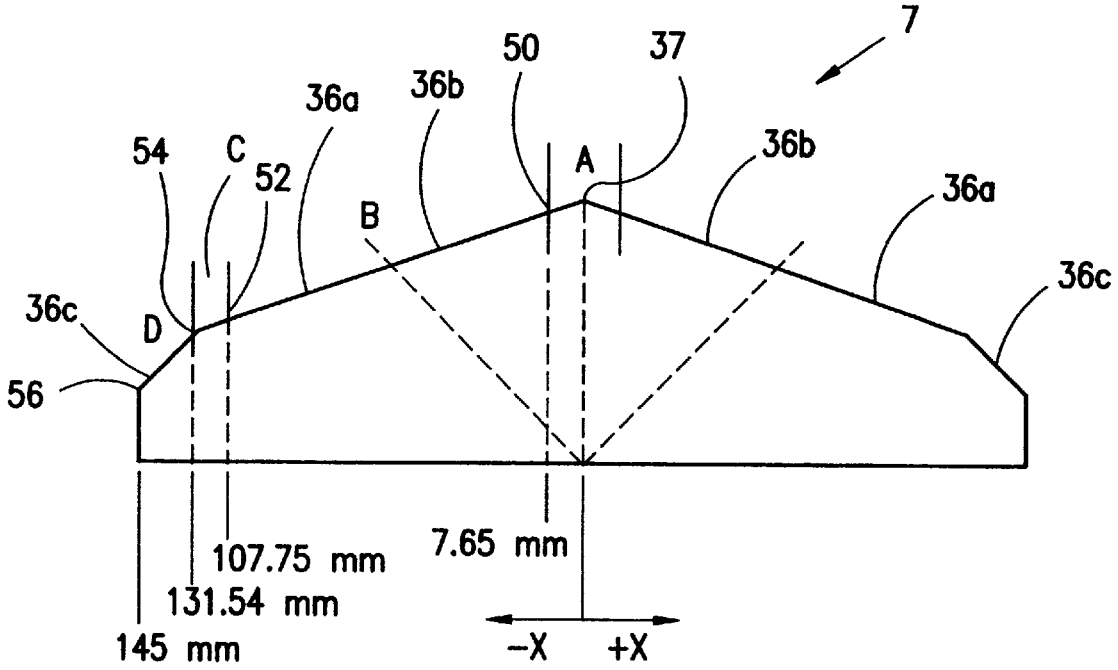
FIG. 8 is a diagram illustrating the geometry of the shaper plate or cam of the ram assembly of the machine of the instant invention.

Consider once more means 7 which is shown in FIG. 8 as a cam piece for determining how the instant invention converts a non-vertical motion into a vertical motion for driving a tool along the vertical direction. As was noted before, cam 7 is divided into a number of portions, namely portions 36*c*, 36*a* and 36*b*, as well as an inversion point 37 at the apex where the two opposed sloping surfaces 36a, 36*b* meet to from an uppermost common area at apex 37.

As is shown in FIG. 4, servo motor mechanism means 25 outputs a torque, or force, to drive a ball screw shaft 21. Mounted to the screw shaft 21 is the nut arrangement 22, which in turn is coupled to the transfer bar 19 for providing the translational movement to the auxiliary body 41 that carries roller 9. For the exemplar machine, assume that each rotation of the screw shaft 21 is a fixed distance, for example approximately 55 mm. Further shown in FIG. 4 is an encoder 26, coupled to servo motor 25, for measuring the number of pulses output from servo motor 25. As is well known, this output of pulses, by means of encoder 26, can be converted into a reading of how many times screw shaft 21 has rotated. Thus, with the output from encoder 26 to the press control 43, i.e., the central numerical controller of the sheet fabrication machine of the instant invention, a precise measurement of the number of rotations of screw shaft 21, and therefore the distance traversed by roller 9, via the movement of transfer bar 19, can be established.

The cam embodiment of FIG. 8 illustrates how the distance traversed by such non-vertical movement can be used for determining the length of the tool, whose movement is along a direction that, as shown in the embodiment of FIG. 4, is vertical.

By empirical studies, the configuration of the ram of FIG. 8 is shown to be divided into 4 zones or areas, namely A, B, C and D. As shown in FIG. 8, apex 37 is considered to be the origin, i.e., 0. Distances extending from either side of apex 37 therefore are considered to be either negative or positive, but the absolute distances away from apex 37, be it positive or negative, are nonetheless the same. Therefore, focusing only to the left side of apex 37, note that the inventors have designated a distance of 7.65 mm, at 50, away from apex 37, as area A. Area B is designated between points 50 and 52, at 107.75 mm. Area C in turn is designated to be between points 52 and 54, i.e. between 107.75 mm and 131.54 mm. Area D is designated to be between points 54 and 56, which is 145 mm away from apex 37. Correlating the ram position with the position of the roller 9 against the surface of cam 7, the equations being presented hereinbelow would provide an operator, and more specifically, the CNC controller, a means to precisely calculate the roller position with the respect to the ram position.

Ram Position

Abs (x)=Position of Roller along x axis

Roller Position When ABX (x)=0 to 7.65 mm $$\text{Ram Position} = 55 - \cos\left(\arcsin\left(\frac{x}{55}\right)\right) * 55 \quad \text{(A)}$$

Roller Position when Abs (x)=7.66 mm to 107.75 mm $$\text{Ram Position}=0.535+\tan(8)*(x-7.65) \quad \text{(B)}$$

Roller Position when Abs (x)=107.76 mm to 131.54 mm a=(x−107.75)

$$\text{Ram Position}=14.6+\sqrt{a^2+55^2-a*55*\cos(98)-55} \quad \text{(C)}$$

Roller Position abs (x)=131.55 mm to 145 mm $$\text{Ram Position } 22.49+\tan(30)*(x-131.54) \quad \text{(D)}$$

Conversely, given the ram position, the position of the roller 9 likewise can be calculated by the following equations.

Ram Position x=0 to 0.535 mm $$\text{Roller Position} = \sin\left(\arccos\left(\frac{x-55}{55}\right)\right) * 55$$

Ram Position x=0.536 to 14.6

$$\text{Roller Position} - \frac{(x-0.535)}{\tan(8)}$$

Ram Position x=14.6 to 22.48

$$\text{Roller Position}=107.75+-15.31+\sqrt{15.31^2+4*((x-14.6+55)^2-55^2)}$$

Ram Position x=22.49 to 30 (max stroke)

$$\text{Roller Position} = 131.52 + \frac{(x-22.48)}{\tan(30)}$$

Thus, given the above equations and given the fact that each turn of ball screw shaft 21 is known to be equivalent to a particular length or distance, for example 55 mm, the movement of the servo motor can be correlated with the movement of ram 1.

With reference to FIGS. 9*a* and 9*b*, a sheet fabrication center or machine that utilizes the mechanism disclosed so far is shown. Specifically, machine 60 has a frame 62, which may be an O frame for example. There is moreover a carriage 64 moveably mounted to frame 62 for moving in a first direction, for example the x direction as shown in FIG. 9*b*, by way of a servo motor (not shown). Carriage 64 also is movable along the y direction, driven by another servo motor (not shown) so that carriage 64 is moveable along both the x and y directions. A number of clamps 66 are mounted along carriage 64 and moveable longitudinally therealong by way of mechanisms described for example in U.S. Pat. No. 4,658,682. Clamps 66 are used to hold a worksheet such as 68 shown in FIG. 9*a*. The worksheet therefore can be moved anywhere along worktable 70 by the movement of carriage 64. A press mechanism 72, which may be a turret punch press mechanism, is mounted to frame 62. As is well known, a plurality of tools may be mounted about the periphery of the turrets so that any particular tool may be selected for effecting work onto worksheets 68 on a corresponding die. Power is provided to machine 60 by way of a power system 74, which will be discussed later as being an economically friendly system for the machine of the instant invention. Controlling the operation of the machine of the instant invention is a central numerical controller (CNC), designated by the operational terminal 76 for example.

Unlike the conventional hydraulics and the old style servo motor driven machines, the machine of the instant invention, in addition to having its upper tool driven by a servo motor mechanism, also has its lower tool, i.e., die, driven by a separate servo motor mechanism. The operation of the lower die, in terms of an exemplar up forming operation, is illustrated in FIGS. 10*a* to 10*e*. Insofar as the servo motor used for outputting the non-vertical force of the die could be the same as servo motor 25 and the assembly connected thereto for driving transfer bar 19, the same type of mechanism is presumed to be operating for driving transfer bar 78 shown in FIGS. 10*a* to 10*e*. As shown, transfer bar 78 has coupled thereto a frame 80 to which is mounted at least one contact means, i.e., roller 82. At the bottom of die 84 there is a flange 86 to which is coupled a wedge part 88. The sleeve of tool assembly 84 extends upwards so that a portion thereof is fixed to the frame at 90. Internal bearings and the internal pneumatic chamber of die 84 enable die 92, mounted thereto, to be moveable in a direction longitudinally aligned with the direction of upper tool 29.

As transfer bar 78 is driven by the servo motor mechanism for the lower tool, frame 80 is moved in a direction, for example the x direction, that is substantially perpendicular to the vertical direction to which the upper and lower tools are aligned. As a consequence, when roller 82 comes into contact with surface 94 of wedge 88, die 92 is driven upwards. The movement of die 92, relative to tool 29, is effected by the back and forth movement of roller 82 against surface 94 of wedge 88.

Figure 10C:
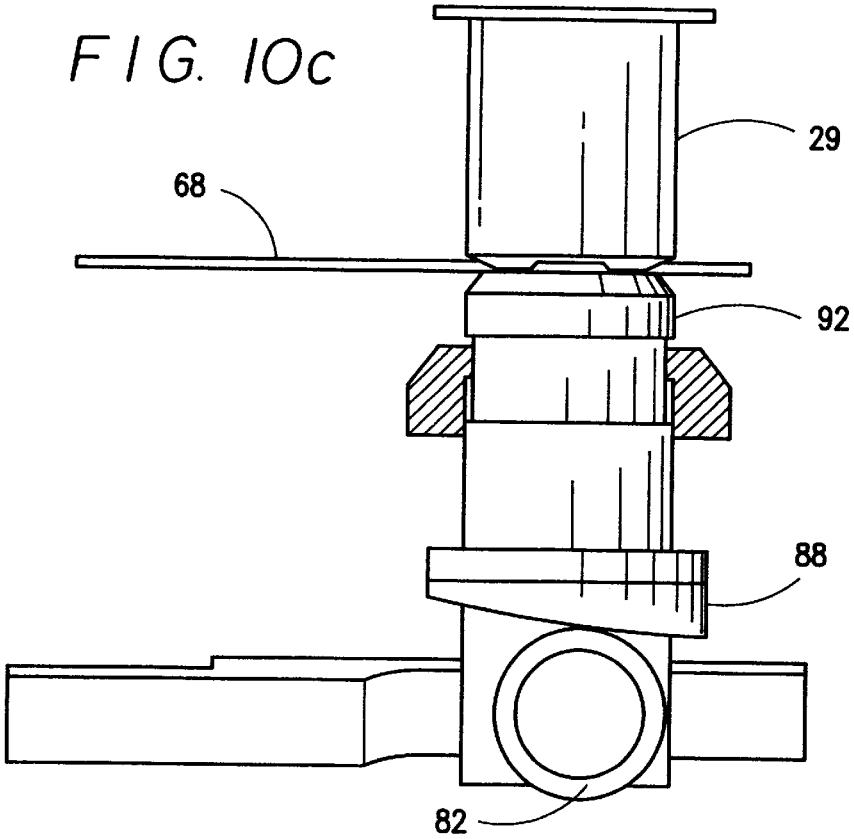
Figure 10D:
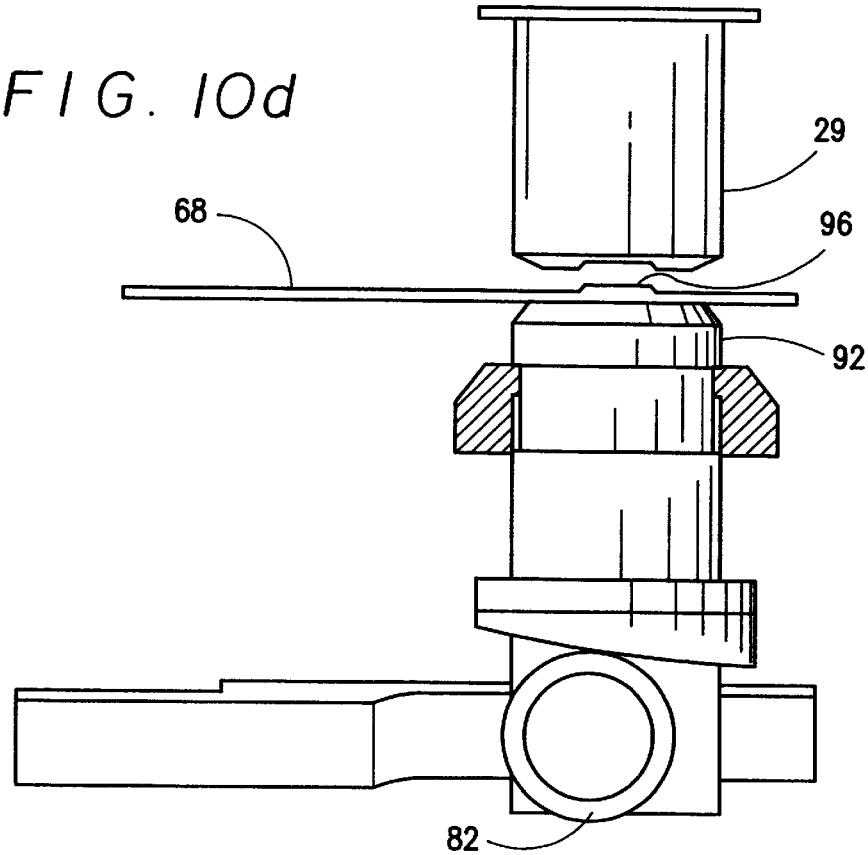
Figure 10E:
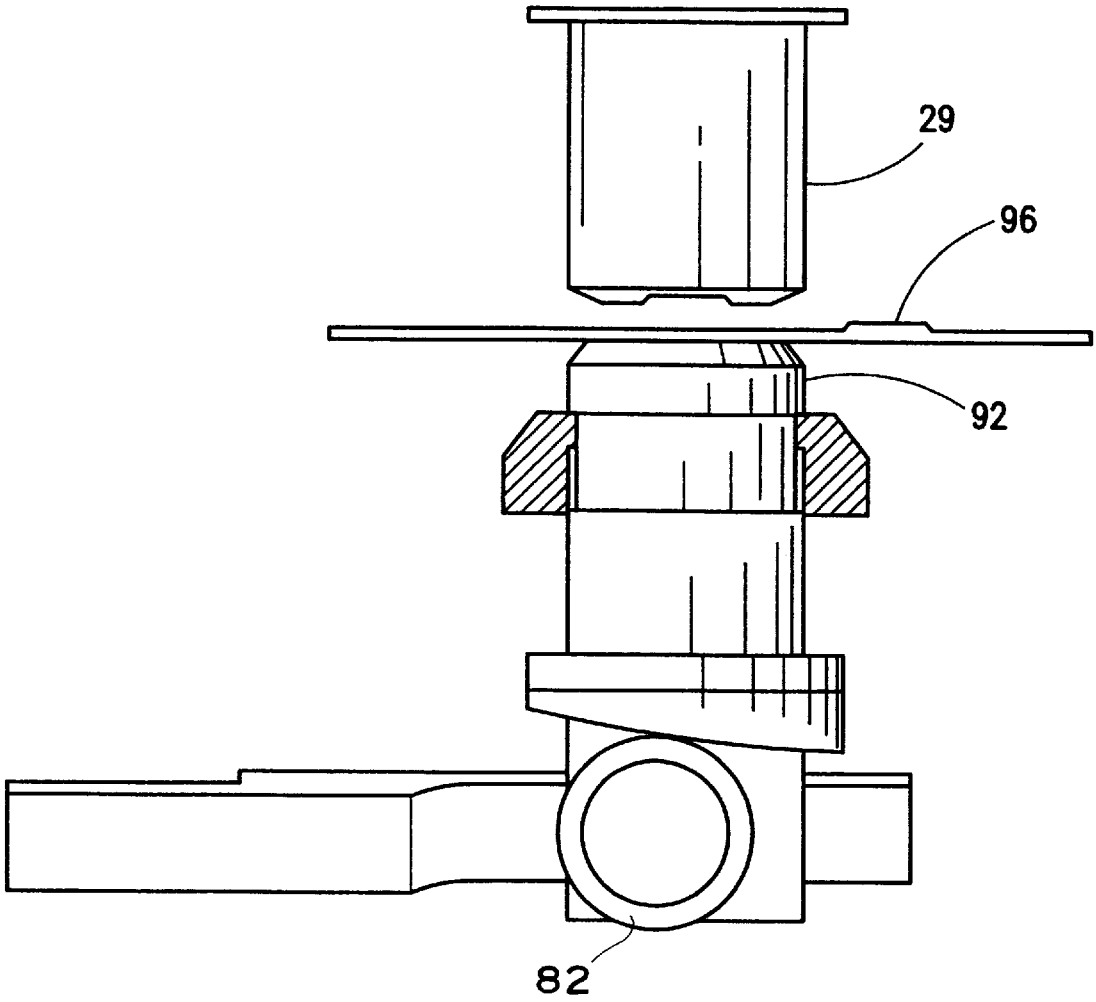

With particular reference to FIG. 10*a*, assume worksheet 68, which is interposed between tool 29 and die 92, is being moved by the x and y axes servo motors over the worktable. In FIG. 10*b*, assuming that worksheet 68 has reached its programmed position, the upper tool 29 is lowered from its upper limit value to its lower limit value, both of which are preset by the operator of the system. Thereafter, as shown in FIG. 10*c*, as soon as upper tool 29 has reached its programmed lower limit, the die, i.e., the lower tool, is driven upwards by roller 82 to its upper limit value so that forming takes place on worksheet 68. When the lower tool 92 has reached its programmed upper position, upper tool 29 retracts to its programed upper position, as shown in FIG. 10*d*. At this point, die 92 returns back to its lower limit. A form, designated 96, is readily shown in FIG. 10d. After die 92 returns to its programmed lower limit, sheet 68 is moved freely and tools 29 and die 92 now await the next upward forming stoke called for in the production program. Note that a marking operation on a worksheet can be similarly performed by the lower tool of the sheet fabrication machine of the instant invention. Such marking operation could include, but not limited to, the marking of bar codes on a worksheet.

Figure 11:
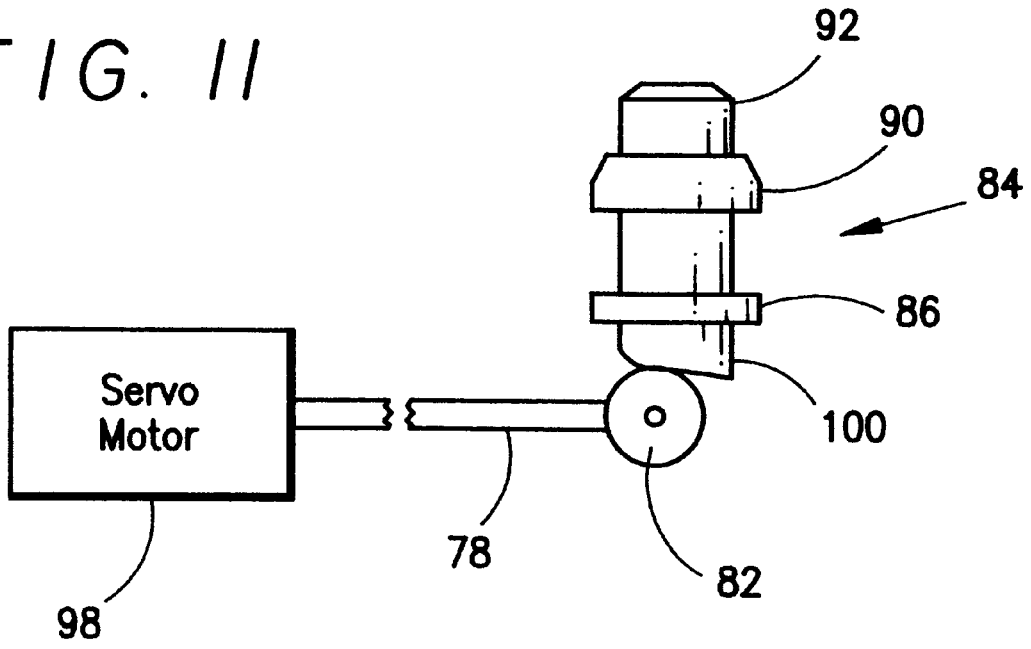
FIG. 11 shows a second embodiment of a driving mechanism for driving the die assembly shown in FIGS. 10*a* to 10*e;*
Figure 12:
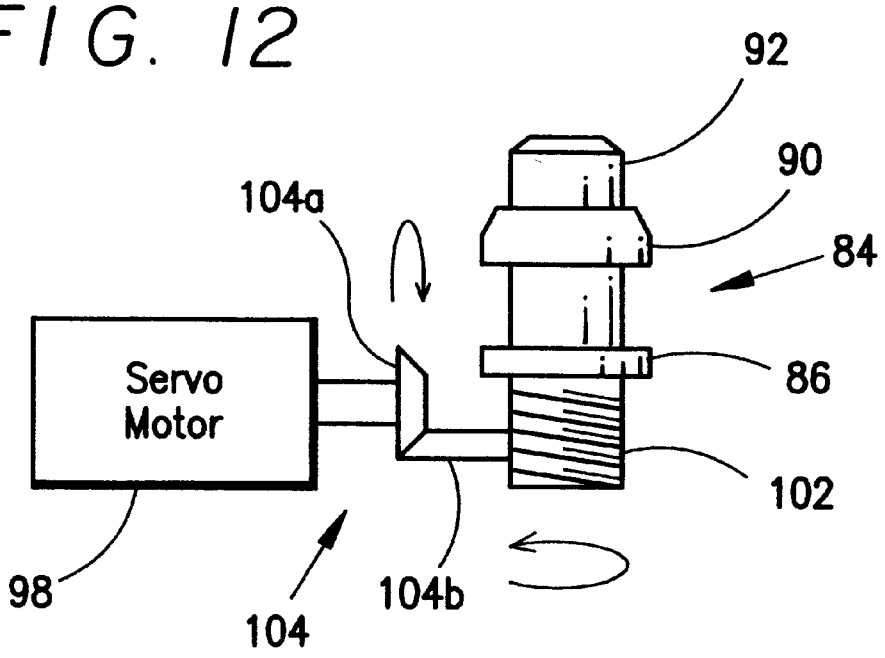
FIG. 12 is yet another embodiment of a mechanism for driving the die assembly shown in FIGS. 10*a* to 10*e;*

FIGS. 11 and 12 each show a different embodiment whereby a configured piece other than a wedge-shaped piece, is coupled to the lower flange 86 of lower tool 84 to enable the conversion of a non-vertical output from servo motor 98 into a vertical output for moving the lower tool assembly 84 in a vertical direction. In the case of the embodiment shown in FIG. 11, note that a ring 100 similar to part 9 of FIG. 3*c* is used for enabling the coaction of die assembly 84 with roller 82 so that any movement of roller 82 along the x direction would cause die assembly to move in a vertical direction. Note that although vertical and non-vertical directions are discussed with reference to FIGS. 1–12, it should be appreciated that the instant invention actually embraces the concept of at least one tool being driven in a direction which is different from the direction of the force output from the driving mechanism. In other words, instead of the upper and lower tools being movable relative to each other along the vertical direction, these tools may in actuality move along a horizontal direction, so long as the output force driving the upper and lower tools are provided in a direction different from the direct ion of movement of the upper and lower tools.

In FIG. 12, yet another embodiment for driving the die assembly 84 in a vertical direction is shown. For this embodiment, a threaded portion 102 is coupled to lower flange 86 of die assembly 84. Threaded portion 102 is coupled to a gear mechanism 104, rotated by servo motor 98. As shown, as gear 104*a* is rotated, coacting gear 104*b* likewise will rotate. Since gear 104*b* is coupled to threaded portion 102, its rotation in turn will cause the rotation of threaded portion 102. This may be done in the form of meshing gears so that as threaded portion 102 is turned, a corresponding screwed portion (not shown) of die assembly 84 will drive die 92 to move vertically. Note that for the FIG. 12 embodiment, instead of being positioned along the x axis, servo motor 98 may be positioned to be beneath the die assembly so that it can directly rotate threaded portion 102. Other forms of mechanisms for driving die assembly 84 by means of rotation of the portion 102 are equally applicable.

Figure 13:
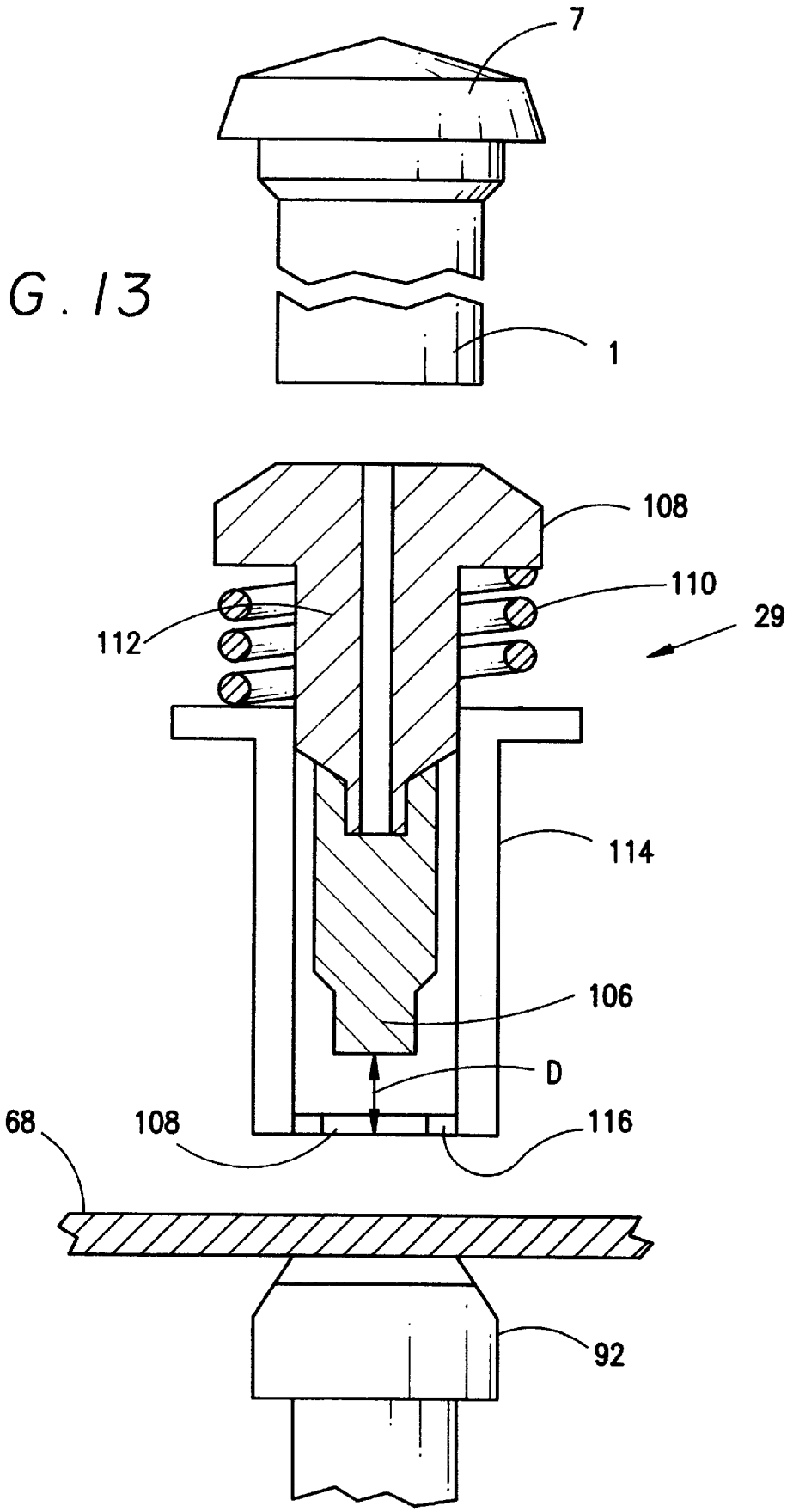
FIG. 13 illustrates in greater detail the tool assembly of the instant invention machine and lays the ground work for providing an explanation of the automatic determination feature of whether adjustment is required for the punch tool of the tool assembly of the instant invention.

FIG. 13 shows in simplified format the various components of the tool means of the machine of the instant invention. As shown, ram 1 has connected to its top portion a force converting mechanism in the form of cam 7. Without showing the turret proper, tool assembly 29 is shown to be in alignment with ram 1 so that the top of tool assembly 29, namely its head 108, is driven by ram 1 when ram 1 comes into contact therewith. Head 108 of tool assembly 29 is supported by a spring 110 which, when absence of a force applied by ram 1, would force head 108 upwards to thereby take along therewith a punch tool 106 coupled to a shaft 112 extending from head 108. Punch tool 106 in turn resides longitudinally within a cylinder 114 of tool assembly 29. At the bottom portion of cylinder 114 there is a stripper plate 116 that maintains worksheet 68 in place after punch tool 106 has penetrated and is being withdrawn from worksheet 68. Note that the tip of punch tool 106, when not being driven by ram 1 to punch worksheet 68, is positioned some distance away from the tip of cylinder 114 through the hole 108 provided by stripper plate 116. This distance between the tip of punch tool 106 and the tip of cylinder 114 is referenced as D. The length of tool assembly 29, simply referred to as tool 29 for future discussion, is provided by the manufacturer of the tool in most instances. Conventionally, the length of the tool 29 is approximately 290 mm.

A customer of the machine of the instant invention ordinarily is cognizant of the length of tool 29. In which case all he needs to do is input the length of that tool into the tool table of the CNC when he begins to operate the machine. The instant invention provides the customer who is not cognizant of the length of the tool the ability to measure such length the first time the operator of the machine uses the tool. This feature of the sheet fabrication machine of the instant invention is illustrated with reference to FIGS. 14 and 15.

Figure 14:
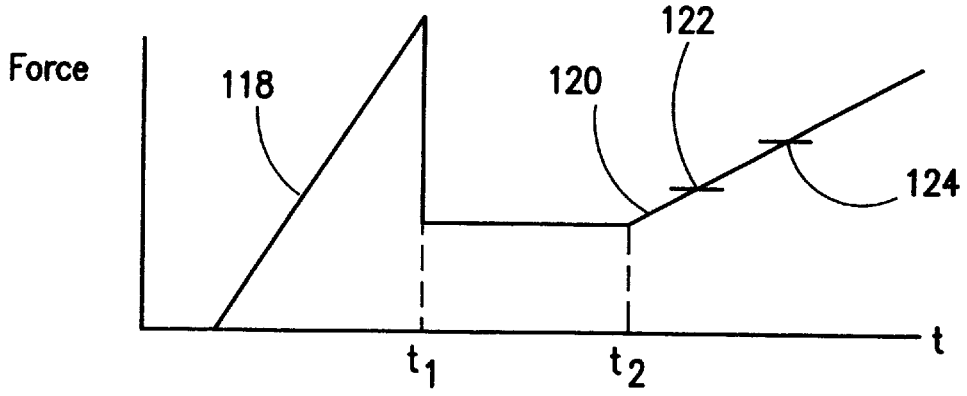
FIG. 14 is a force diagram illustrating the torque or force output from a servo motor for driving the ram of the instant invention machine.

To begin, there is defined in the CNC a distance that should be fixed between the bottom of the tool and the top of the die. This distance F is ordinarily fixed to be 205±0.2 mm. Thus, with the embodiment of the upper tool shown in FIG. 15, when roller 9 is moved to the position as shown, the tool must be at least 205 mm plus some distance that would enable it to penetrate through sheet 68. Having said that, focus to the force versus time diagram of FIG. 14 which in reality measures the torque output from the servo motor that drives tool 29. As shown, the force begins to increase at a quick pace. as indicated by the slope of 118. At time $t_1$, it decelerates perceptibly so that in essence tool 29 begins to coast toward die 92. At time $t_2$, contact is made by tool 29 to sheet 68, or in the instance where there is no worksheet, die 92. At this time, the torque output from the servo motor again increases, as indicated by upward slope 120, to a predetermined limit, for example at 122, defined by either the manufacturer or the customer. This limit 122, as shown in FIG. 14, corresponds to the point where the user, if given such an indication, would known that indeed tool 29 has made contact with a solid surface, and that force once more needs to be increased for effecting work. This limit 122 is dependent on a number of factors which include for example the spring force exerted by spring 110 (FIG. 13). When limit 122 is reached, the servo motor stops outputting any additional torque or force. The force thus exerted is then recorded into a memory store. With the thus determined force now stored, and given that it is known that each rotation of the ball screw shaft 21 (FIG. 4) corresponds to a fixed length, for example 55 mm, for the exemplar embodiment of the machine shown in FIG. 4, the tool length of tool 29 can therefore be readily calculated.

In addition to limit 122, a second limit. such as for example 124 could also be provided as an upper limit to inform the operator that adjustment of the punch tool 106 within the tool assembly 29 is required. More on that later.

Further with respect to FIG. 14, given that when a tool comes into contact with either the workpiece or the die can be determined automatically, another aspect of the sheet fabrication machine of the instant invention is the ability of the machine to automatically determine a base or a setting wherefrom the operation of the tool can be referenced. This is done in conjunction with the recording of the force, at limit 122, into the memory store of the machine. By designating this force as being the base setting, all work performed by tool 29 thereafter can be referenced with respect to the thus stored force. Of course, the force may be converted into a base number, or some other measurement, such as 0, that would enable an operator to quickly determine that the tool setting is at its correct position with respect to a worksheet or the die, before work is to be performed.

Figure 15:
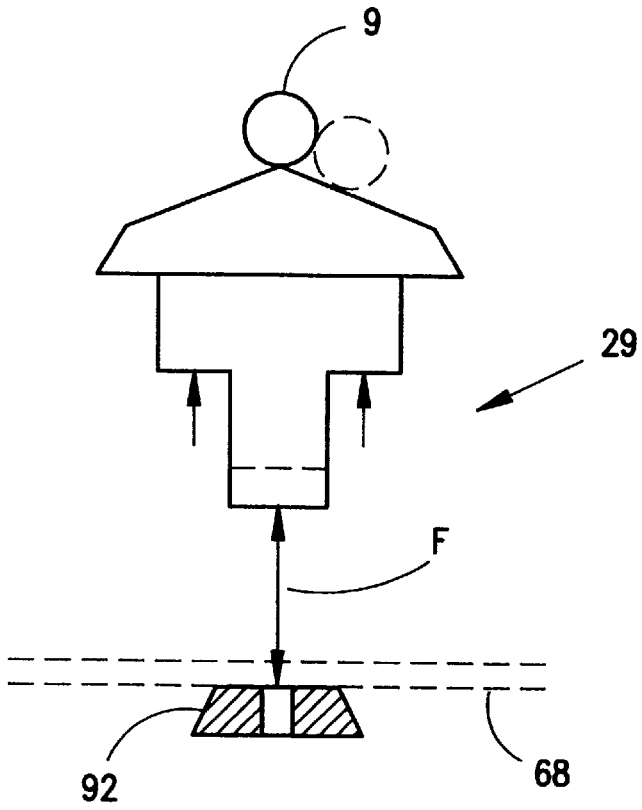
FIG. 15 is a schematic for demonstrating the relative distance separating the tool from the die.

With reference to FIGS. 13, 14 and 15, note that when tool 29 is driven into contact with either worksheet 68 or die 92, a force that corresponds to limit 122 is first reached. Thereupon, in order to continue to push punch tool 106 within tool assembly 29 so as to move it vertically into contact with worksheet 68, a greater torque needs to be generated by the servo motor in order to press punch tool 106 against work sheet 68, and eventually to penetrate and punch the piece out from worksheet 68. Accordingly, a continuous increase of torque or force is monitored per slope 120 of FIG. 14 until a point is reached whereat the to be cut piece is punched out from worksheet 68. This point is dependent on the thickness of the worksheet and can be calculated and determined by empirical studies.

Assuming that this point is equal to the upper limit 124 as indicated in FIG. 14, then theoretically, once this point is reached, the force output from the servo motor would decrease. With that in mind, in the case where, as shown in FIG. 14, the torque output from the servo motor, as represented by the upward slope 120, continues to increase beyond upper limit 124 would indicate to an operator that additional force is required to drive punch tool 106 to make contact with worksheet 68. This means that punch. tool 106 never did make contact with worksheet 68 at limit 124. This may result from the fact that the distance D separating the tip of punch tool 106 from the tip of cylinder 114, as represented by the stripper plate 116, is so great that it takes more than the force between lower limit. 122 and upper limit 124 to push punch tool 106 beyond stripper 116 to cut worksheet 68.

That being the case, once an operator has determined that indeed the servo motor continues to generate an output force even though upper limit 124 is reached, he knows that adjustment of distance D is required, in order to ensure that punch tool 106 would penetrate and punch the appropriate piece out of worksheet 68, when upper limit 124 is reached. Consequently, the operator needs to stop the operation of the sheet fabricating machine, withdraw tool assembly 29 out of the upper turret, and readjust the distance D. The sheet fabricating machine of the instant invention therefore provides the additional feature of enabling an operator to determine whether or not positional adjustment of the punch tool within a tool assembly is required. Note that this positional adjustment of the punch tool within a tool assembly is equally applicable for forming and punching operations by the upper tool.

Figure 16A:
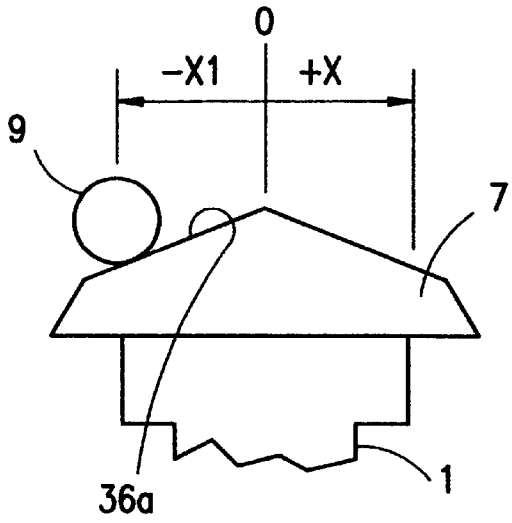
FIGS. 16*a* and 16*b* illustrate the forming operation effected by the upper tool of the instant invention to a worksheet.
Figure 16B:
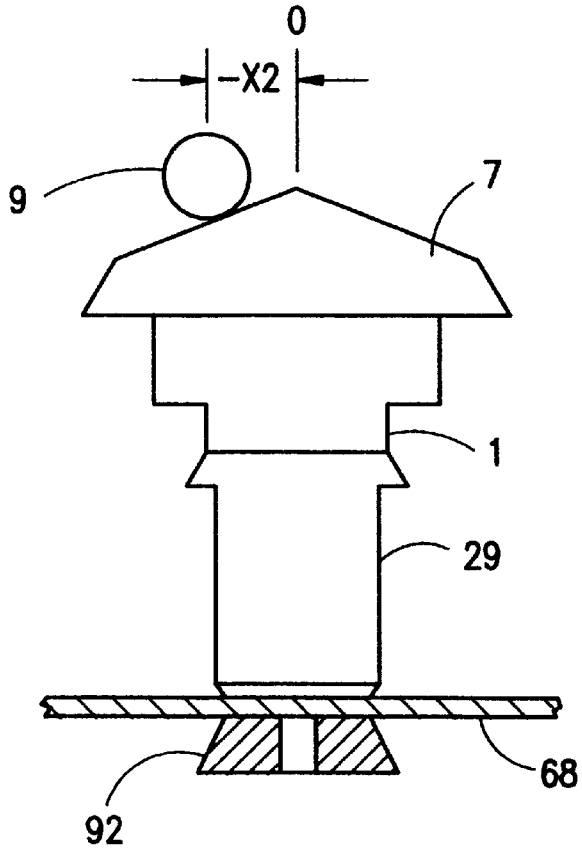

With reference to 16*a* and 16*b*, note that the position of roller 9, with respect to its contact with cam 7 of ram 1, as it traverses along surface 36*a* or area B of cam 7, is stored into the memory of the controller of the machine so that, as shown in FIG. 16*b*, when the tip of tool 29 comes into contact with worksheet 68, the position of roller 9 may be stored as a base setting wherefrom future operations of the tool are referenced. Thus, the difference in the traversing distance of roller 9 between FIGS. 16*a* and 16*b* can clearly be determined, as for example between 4 to 5 mm, so that tool 29 can easily effect work on worksheet 68, be it a punching, mark or forming operation. Further, given that, as was mentioned earlier, the distance between the top of the ram and the bottom of tool 29 has been set for example at 205 mm and that the length of tool 29 is usually approximately 209 mm, by subtracting the distance of the tool from the distance F (FIG. 15) separating tool 29 and die 92, the thickness of worksheet 68 can readily be calculated.

Figure 17:
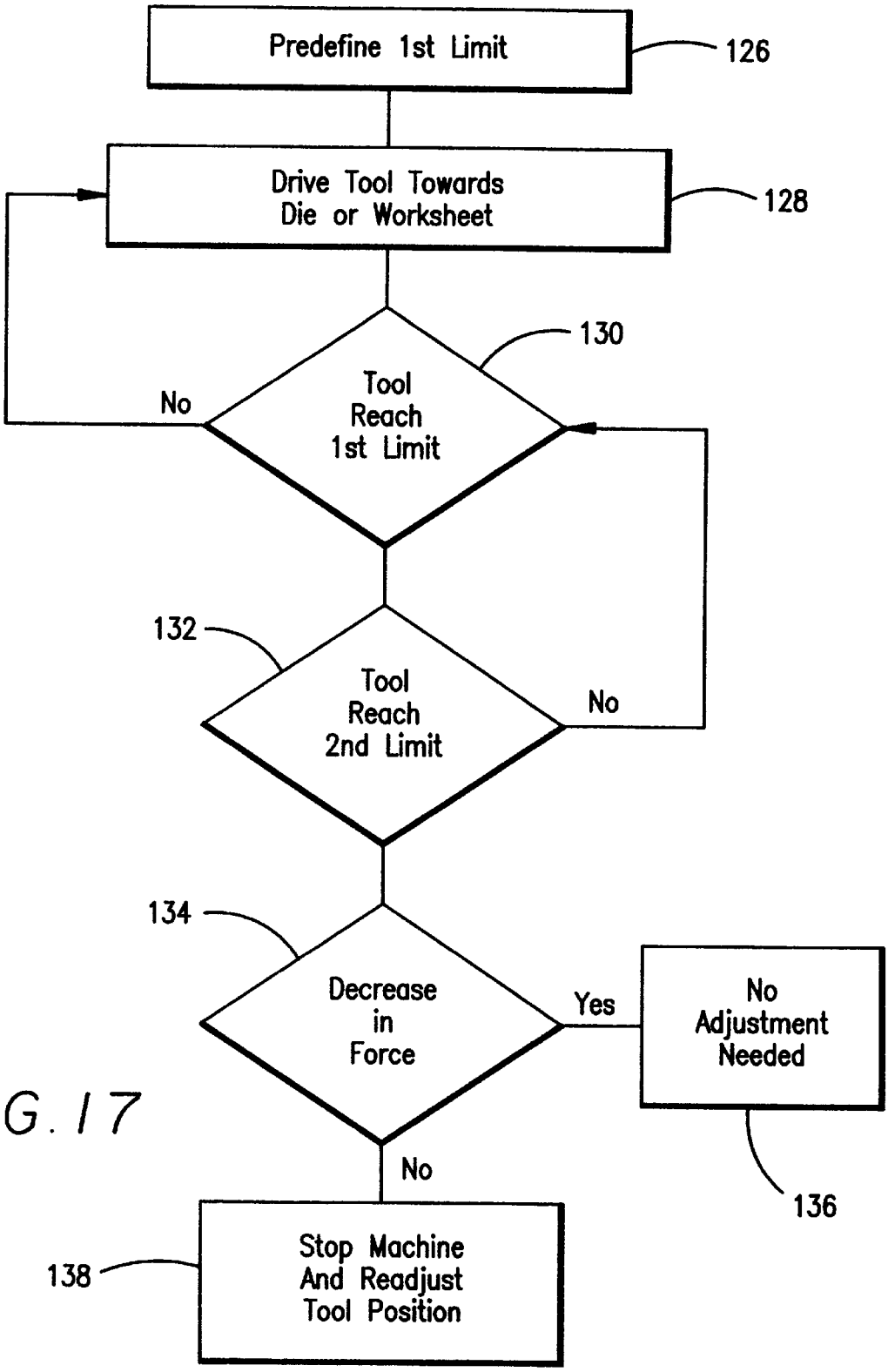
FIG. 17 is a flow chart for illustrating the procedure for measuring and adjusting of the punch tool in the tool assembly of the machine of the instant invention.

A flow chart illustrating the steps taken by the CNC of the sheet fabricating machine of the instant invention for determining the length of the tool, the thickness of the worksheet, as well as the adjustment of the punch tool within the tool assembly, is given in FIG. 17. As shown in step 126, a first limit, such as for example limit 122, is predefined. Thereafter, tool 29 is driven towards die 92 or worksheet 69, per step 128. A determination is then made on whether the tool has reached the first limit by monitoring the force that is being exerted by the servo motor, per step 130. In place of the monitoring of the torque output from the servo motor, a discrete monitoring device such as for example a sensor gauge or light sensor means could also be used for step 130. If it is determined per step 130 that the tool has not yet reached the first limit, the controller of the machine will continue to drive tool 29 towards die 92. On the other hand, if it is determined that tool 29 indeed has reached the first limit, then a second determination is made on whether tool 29 has reached a second limit, such as for example limit 124, per step 132. If there is indeed a decrease in force output from the servo motor, as determined per step 134, then the controller of the system would determine that no adjustment of the punch tool within the tool assembly is required, per step 136. On the other hand, if there has not been any decrease in the output torque from the servo motor, as determined per step 134, then the machine is either automatically stopped or the operator can stop the machine, per step 138, so that the relative distance between the tip of the punch tool and the stripper plate may be readjusted.

Figures 18A, 18B, 18C, 18D:
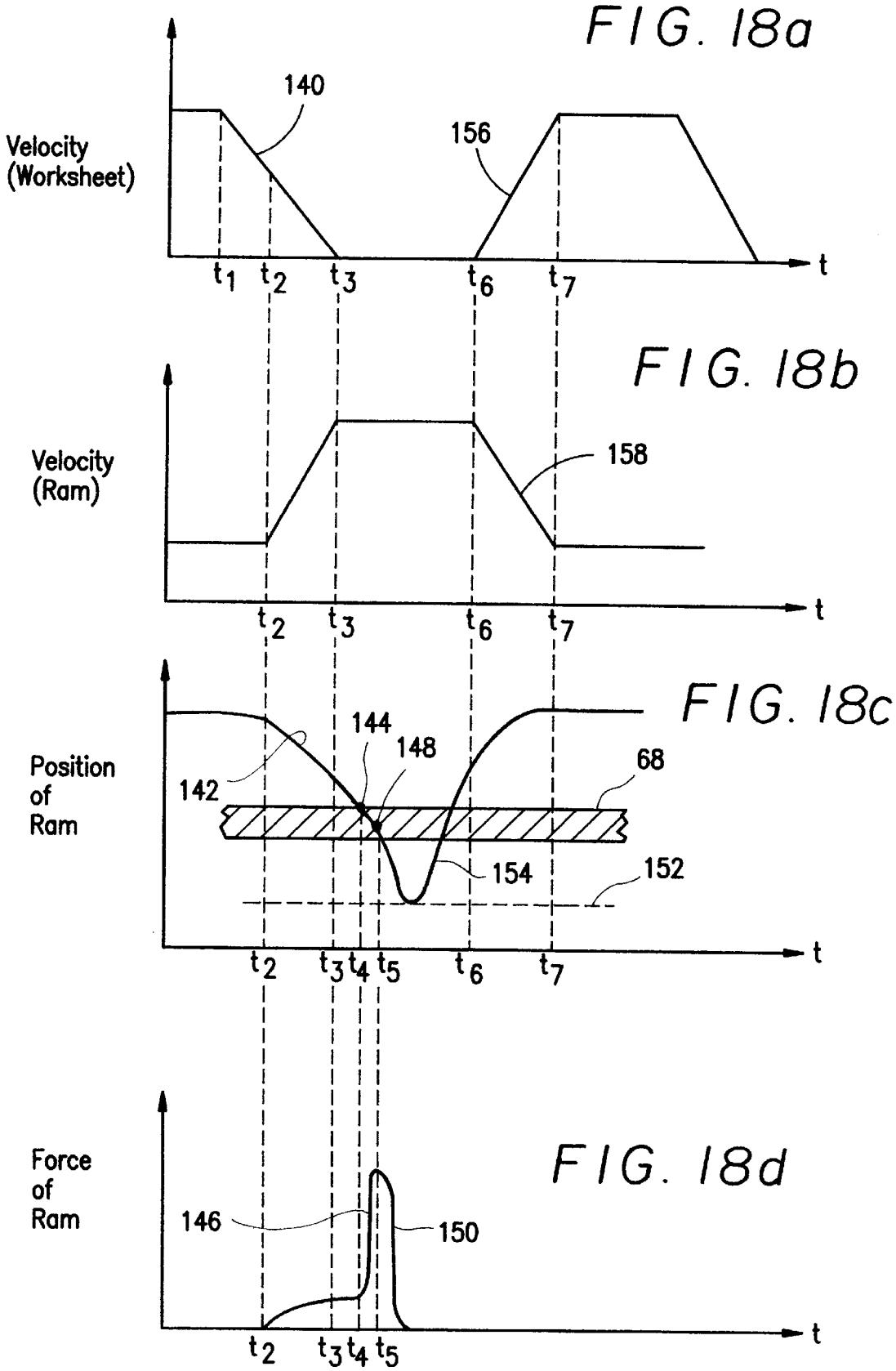
FIGS. 18*a* to 18*d* are various timing diagrams that illustrate the relationship between the speed of the movement of the worksheet, the speed and positioning of the ram in relationship to the movement of the worksheet, and the relative force applied to the ram.

With respect to FIGS. 18–18*d*, the respective velocities or speeds of the worksheet and the ram, as well as the position of the ram and the force output from the servo motor for driving the ram are shown. In particular, with reference to FIG. 18*a*, note that the speed of the worksheet begins to decrease at time $t_1$. At that time, the speed of the ram remains constant insofar as there is no output torque from the servo motor. But at time $t_2$, sometime during the deceleration of the movement of the worksheet, as indicated by downward slope 140, a torque is output from the servo motor so that the ram begins to be accelerated toward the worksheet. See FIG. 18*b*. At the same time, with reference to FIG. 18*c*, note that the position of the ram is such that it has been lowered toward worksheet 68, as shown by the downward slope 142 of FIG. 18*c*. At the same time, as shown in FIG. 18*d*, the force or torque output from the servo motor is increased.

At time $t_3$, the portion of the worksheet that is to be machined has been moved to the appropriate location underneath the ram as indicated per FIG. 18*a*. In other words, at that time, the worksheet becomes stationary. At the same time, as shown in FIG. 18*b*, the velocity of the ram has reached its peak. This means that the force output from the servo motor has also leveled off, as indicated by the force diagram of FIG. 18*d*. However, the ram has yet to reach worksheet 68, as indicated by the position graph of FIG. 18*c*.

This is all changed at time $t_4$ when the punch begins to make contact with worksheet 68, at point 144, as shown in FIG. 18*c*. At that time, the torque output from the servo motor increase perceptibly insofar as an increased force is required to punch through the sheet material. This is indicated by the upward slope designated 146 as shown in FIG. 18*d*. At time $t_5$, when the punch is at the position as indicated at 148, the portion of the worksheet that is to be punched out of worksheet 68 will begin to break away from the worksheet. Consequently, there is an abrupt decrease in the amount of force output from the servo motor, as indicated by the downward slope 150 shown in FIG. 18*d*. The punch tool then is driven beyond worksheet 68 so as to finally end up at its lowermost position, or limit, as indicated by dotted line 152 in FIG. 18*c*. Thereafter, as the ram is pulled back from tool 29, the punch tool begins to be retracted from worksheet 68. This is indicated by the upward slope 154 shown in FIG. 18*c*. At time $t_6$, the controller of the machine determines that the punch tool has been raised to a sufficient distance above worksheet 68 that acceleration of the worksheet can once again resume. This is indicated by the acceleration slope 156 shown in FIG. 18*a*. Similarly, the velocity of the ram is slowed, per the downward slope 158 shown in FIG. 18*b*. Finally, at time $t_7$, the worksheet is moved at its maximal speed while the speed of the ram has subsided to wait for the positioning of the worksheet to its next location.

Figure 19:
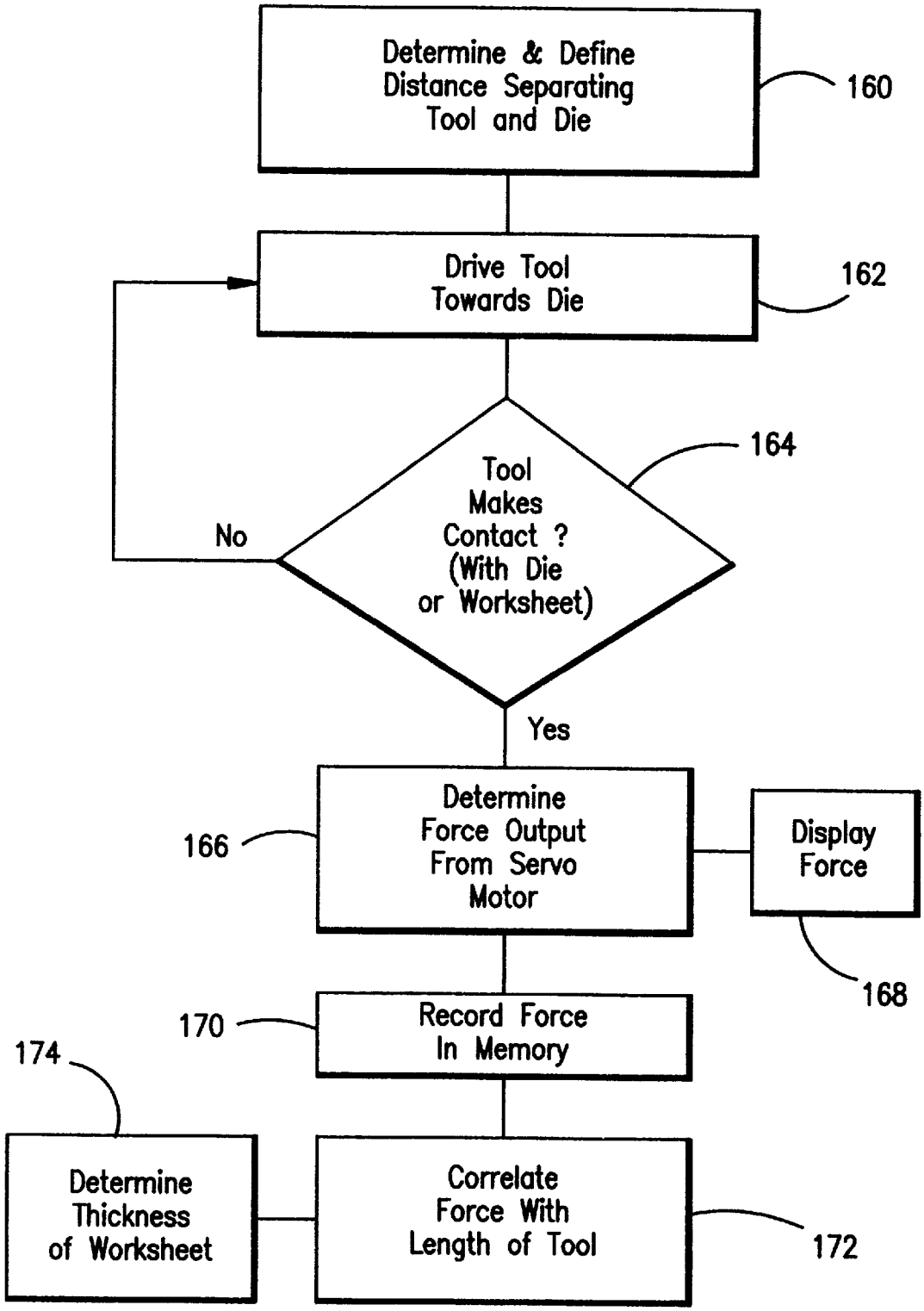
FIG. 19 is a flow chart illustrating the steps taken to determine the length of the punch tool used in the machine of the instant invention.

A flow chart that illustrates the correlation between the torque output from the servo motor and the length of the tool, as well as the thickness of the worksheet, is given in FIG. 19. As shown, at step 160, the controller of the system determines and defines a distance that separates the tool from the die. The servo motor is then energized to drive the tool toward the die, per step 162. A determination is then made in step 164 on whether the tool has made contact with either the die or the worksheet. If there has not been any detected contact, the controller continues to drive the tool toward the die. On the other hand, if it is found that the tool has made contact with either the die or the worksheet, then the force output from the servo motor is determined per step 166. This force is displayed per step 168. At the same time, the force is recorded in the appropriate memory store per step 170. This recorded force is then used to correlate with the length of the tool, per step 172. If desired, the recorded force can also be used to determine the thickness of the worksheet, per step 174.

Figure 20:
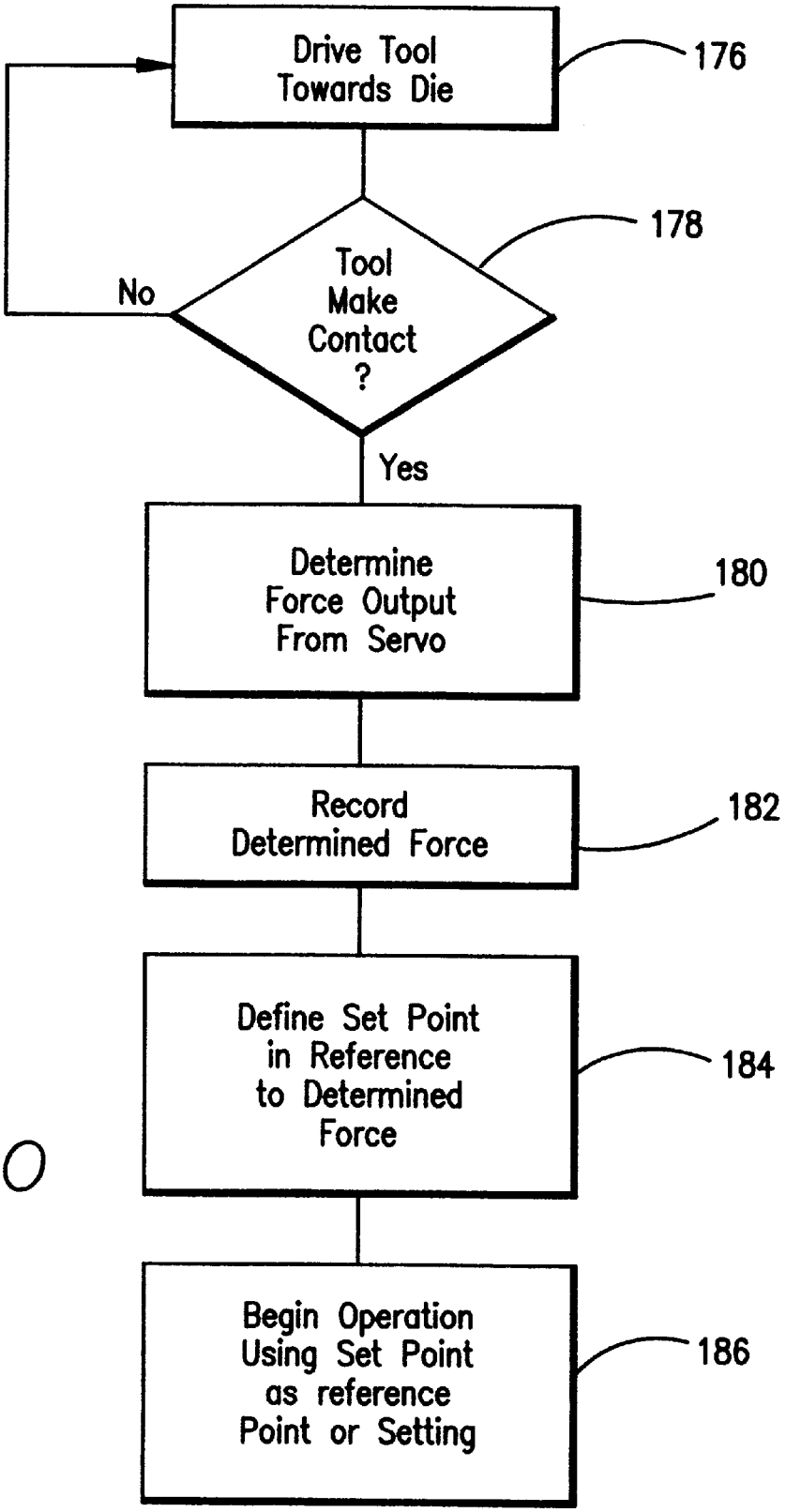
FIG. 20 is a flow chart illustrating the procedure in which a base setting is determined for the operation of the punch of the instant invention machine.

The procedure for setting the base from which the tool is referenced to begin operation is given in the flow chart of FIG. 20. As shown, per step 176, the tool is driven towards the die. Whether the tool has made contact with the die, or a worksheet placed over the die, is detected per step 178. If no contact is detected, then the controller of the machine continues to drive the tool towards the die. If contact is determined, then, per step 180, the force output from the servo motor is determined. Thereafter, the determined force is recorded per step 182. A set point is then defined as the reference from which the operation of the tool can be based, per step 184. Thereafter, the machine can begin its operation using the set point as its reference base, per step 186.

Yet another function of the sheet fabrication machine is illustrated with respect to FIGS. 21*a* to 23*b*. In particular, this function could be referred to as an "intelligent noise reduction" function in which the position of the punched tool is measured with respect to the torque output from the servo motor for determining the correct acceleration/deceleration point, with the decelerated speed being based on the cutting area of the tool, which can vary for the different tools.

Focus to FIGS. 21*a* and 21*b*. As shown, the speed with which the ram is driven is shown to be increasing per upward slope 188 from time 0 to time $t_1$. As the ram speed increases, the position of the ram, as it moves toward worksheet 68, is such that it traverses towards worksheet 68 at a quick pace, as indicated by the downward slope of ram position 190. The ram speed then levels off between time $t_1$ and $t_2$, as shown in FIG. 21*a*. At the same time, the position of the ram continues unabated until it reaches time $t_2$. At this point, the controller, recognizing that it is within only a short distance from the surface of worksheet 68, instructs the servo motor to begin to decrease the acceleration of the ram, thereby resulting in a decreased acceleration as indicated by downward slope 192. At time $t_3$, the tool makes contact with worksheet 68. With the decrease in the speed of the ram, a decrease in the noise generated when the ram hits the worksheet results. The speed of the ram during this period is maintained level, per indicated by 194 in FIG. 21*a*. The decelerated ram speed is maintained as the ram cuts through the worksheet and passes point 196, whereat the portion of the worksheet that is to be punched out from the rest of the worksheet is reached.

At time $t_4$, the tool has penetrated beyond the bottom surface of worksheet 68. Accordingly, the force output from the servo motor decreases, as there no longer is anything reacting against the punch tool. The tool thereafter accelerates to its lowermost position, at point 198, and begins to be accelerated from worksheet 68, per slope 200. This is reflected by the speed of the ram, as indicated by upward slope 202 in FIG. 21*a*. The process then begins anew, at time $t_5$. Thus, given that the speed of the tool is slowed when the tool is in imminent contact with the worksheet means that there is less noise generated as a result of the tool making contact with the worksheet. This is of significance insofar as it is well known that the majority of the noise generated by a punch press results. from the worksheet being punched by the tool. Simply put, the decibel (dB) of noise resulting from the operation of the sheet fabrication machine of the instant invention could be kept to below a predefined limit by maintaining a precise control of the speed with which the tool is driven by the servo motor to effect work on the worksheet.

FIG. 22 illustrates the relationship between the speed the ram is driven and the cutting area of the tool. As shown, it is an inverse function in that as the cutting area of the tool increases, the ram speed is decreased. Conversely, when the cutting area of the tool decreases, the ram speed is increased. This: relationship is due to the fact that in most cases the cutting area depends on the linearity of the sheet movement. In other words, if the movement of the sheet, from one to be punched location to the next, is greater than the longest dimension of the cutting area of the tool, then the whole cutting area of the tool is used in punching. On the other hand, if the movement between cutting locations is such that it does not exceed the cutting area of a tool, then there is no need to increase the speed of a tool, as only a portion of the cutting area of the tool is used for punching the worksheet. The relationship with respect to the cutting area and the speed of the ram being driven by the servo motor is given by the following formulas:

If $A<=A_{min}$, use $V=V_{max}$

If $A>A_{min}$ and $A<=A_{max}$, use $V_{max}=(V_{max}-(A-A_{min})*(V_{max}-V_{min})/(A_{max}-A_{min})$ If $A>A_{max}$, use $V=V_{min}$ where A=cutting area of punch tool The respective cutting areas of the various tools are given as follows:

round: $A=X*\pi*s$ square: $A=4*X*s$ rectangle: $A=(2*x+2*y)*s$ where s=sheet thickness, and A=cutting area of punch tool Thus, if b (sheet movement) is greater or equal to x (the longest tool dimension), then the area to be used is the complete cutting area of the tool. On the other hand, if b is less than x, then the area to be used (a) is equal to the area A * (b/x) where b equals to the sheet movement and x equal to the longest tool dimension.

Figure 23B:
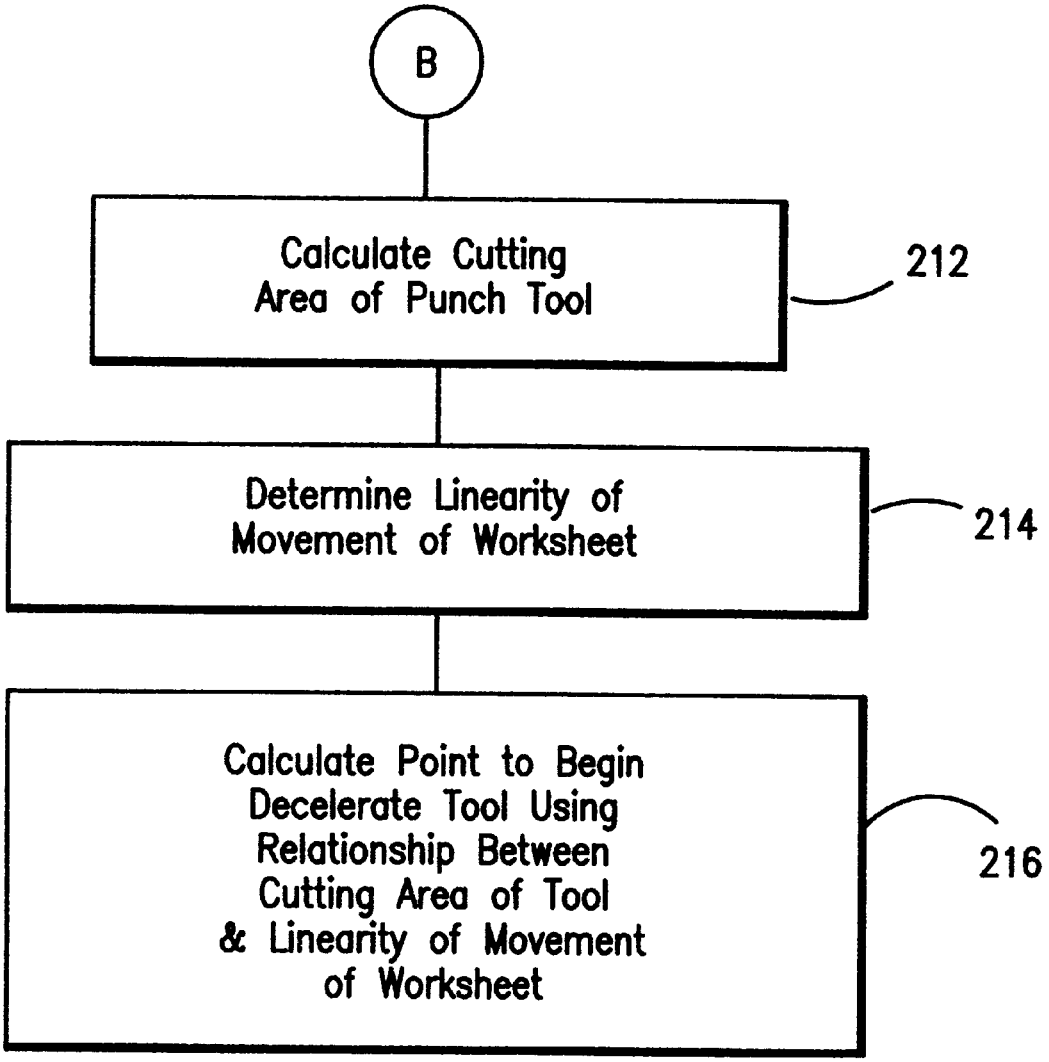

The process as outlined above with respect to the discussion of the ram speed, ram position and the relationship between the cutting area of the tool and the ram speed is given in the flow charts of FIGS. 23*a* and 23*b*. As shown, at step 204, the tool is accelerated towards the worksheet. A determination is then made on whether the tool has approached a predefined limit, such as for example point 195 of FIG. 21*b*. If it has not, the controller of the machine continues to accelerate the tool towards the worksheet. If it has, as determined in step 206, the process proceeds to step 208 so that the torque output from the servo motor is decreased to slow down the movement of the tool. Thereafter, the worksheet is punched, per step 210.

The punching of the worksheet is further elaborated in the flow chart of FIG. 23*b*. There, at step 212, the cutting area of the punch tool is calculated. This of course is done prior to the punching of the worksheet. At step 214, a determination is made of the linearity of the movement of the worksheet. This is done for example by determining the output forces from the x and y axes servo motors that control the movement of the worksheet. Next, at step 216, the point to begin decelerating the tool, which is based on the relationship between the cutting area of the tool and the linearity of the movement of the worksheet, is calculated.

Return to FIG. 23*a*. As shown, after step 210, a determination is made at step 218 on whether the tool has approached a limit near the point where the punched piece would separate from the worksheet. This point is indicated as 196 in FIG. 21*b*. If this limit has not yet been reached, the controller would continue its decreased movement of the tool, as indicated by the downward slope shown in FIG. 21*b*. If indeed limit 196 is reached, then the process proceeds to the next step 220, as the controller instructs the servo motor to increase its torque to accelerate the tool away from the worksheet, as reflected by the upward slope 200 shown in FIG. 21*b*. Next, the process continues to step 222 for making a determination of whether a given safe location above the worksheet is reached. If not, the controller would continue to instruct the servo motor to increase its torque for moving the tool away from the worksheet. If indeed the given safe location above the worksheet has been reached, then the process proceeds to step 224 to move the next to be punched location of the worksheet underneath the ram. So long as the next to be punched location has not yet been moved under the punching area, the movement of the worksheet continues. Once the next to be punched location is moved under the ram, the process proceeds to step 226 for making a determination on whether the fabrication process is to be ended. If it is to continue, then the process proceeds back to step 204 for the next set of operations. If the fabrication process indeed is to end, then of course the process stops.

Figure 24:
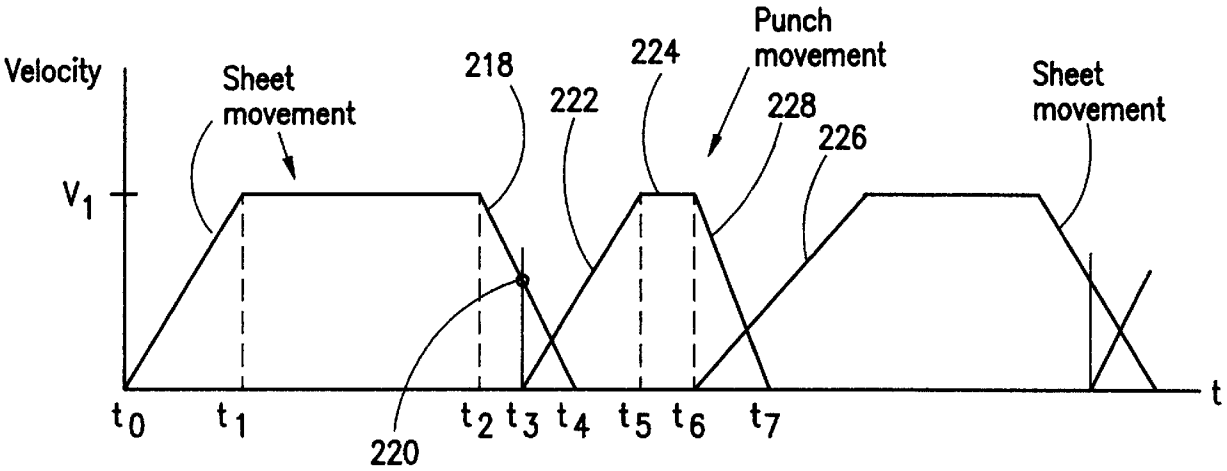
FIG. 24 is a time versus velocity graph showing the simultaneous acceleration/deceleration of the punch tool and the worksheet.

With reference to FIG. 24, a "look ahead" function for simultaneously accelerating/decelerating the movement of the worksheet and the movement of the punch is illustrated. As shown, at each cycle, which could be approximately 7.625 ms, there are corresponding movements of the worksheet and the punch. As shown, the movement of the worksheet begins at time $t_0$, with acceleration to $t_1$. Once the acceleration of the worksheet has reached $t_1$, the movement of the worksheet continues until time $t_2$. At that time, deceleration of the worksheet begins, as indicated by the downward slope 218. At point 220, which is indicated at time $t_3$, the servo motor begins to output a force to drive the punch. This is indicated by the upward slope 222. As shown, the movement of the punch begins before the movement of the worksheet has stopped. This is based on the desire to increase the operational speed of the machine by incorporating both the movement of the worksheet and the movement of the tool.

Continuing with FIG. 24, note that at time $t_4$, the movement of the worksheet stops. In other words, the location of the worksheet whereat a punching operation is to take place has been positioned to be directly under the tool. In the meantime, the acceleration of the punch movement continues until time $t_5$ whereat the punching of the worksheet takes place. This punching of the worksheet occupies the time between $t_5$ and $t_6$, as indicated by 224. At time $t_6$, insofar as the punching operation has ceased, the worksheet is again moved, by means of its x and y axes servo motors, as indicated by the upward slope 226. At the same time, the servo motor begins to decelerate the movement of the punch, as indicated by the downward slope 228, until, at time $t_7$, the punch has been moved to the given safe distance above the worksheet. The process thus continues with the interrelated movements of both the worksheet and the punch as indicated in FIG. 24, to thereby achieve a maximal operational speed for the sheet fabrication machine of the instant invention, while at the same time minimizing the noise that is being generated by the operation. In sum, as shown in FIG. 24, the sheet fabrication machine of the instant invention begins its punching action before the worksheet has completely stopped, so that the actual punching of the worksheet could take place as soon as the sheet movement has stopped.

Figure 25:
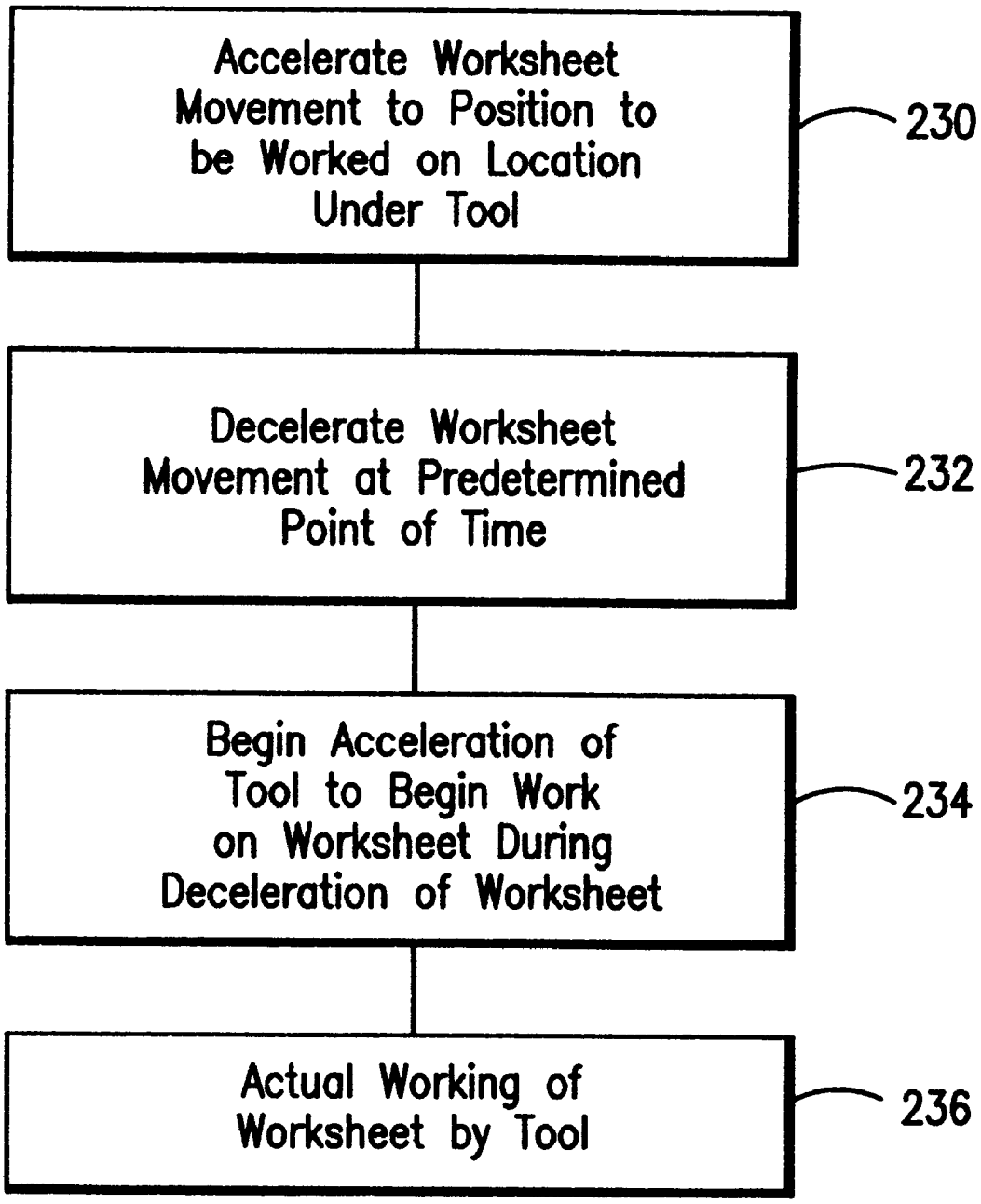
FIG. 25 is a flow chart illustrating the steps taken by the processor controller of the instant invention machine for controlling the acceleration/deceleration of the worksheet and punch tool.

A flow chart illustrating the steps to be taken with respect to the simultaneous acceleration/deceleration of the worksheet and the punch is given in the flow diagram of FIG. 25. As shown, at step 230, the worksheet is accelerated to position its to be worked on location underneath the tool. At a predetermined point of time, the servo motors controlling the acceleration/deceleration of the worksheet begins to decelerate the movement of the worksheet, per step 232. The weight and inertia of the worksheet will continue to decelerate the worksheet for a given period of time such as for example illustrated by the downward slope 218 shown in FIG. 24. At step 234, acceleration of the tool begins for effecting work on the worksheet, while the deceleration of the worksheet continues. At step 236, actual performance of work on the worksheet begins, as the movement of the worksheet has stopped and the tool has contacted the worksheet and has begun effecting work on the worksheet.

Figure 26:
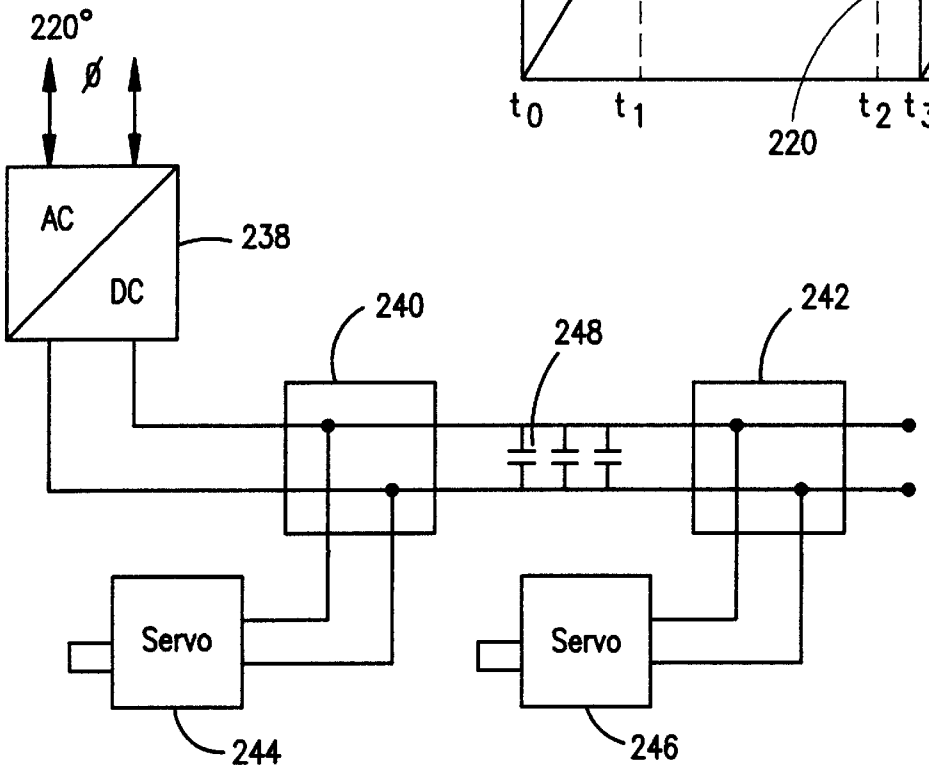
FIG. 26 is a diagram illustrating the energy saving system of the machine of the instant invention.
Figure 27:
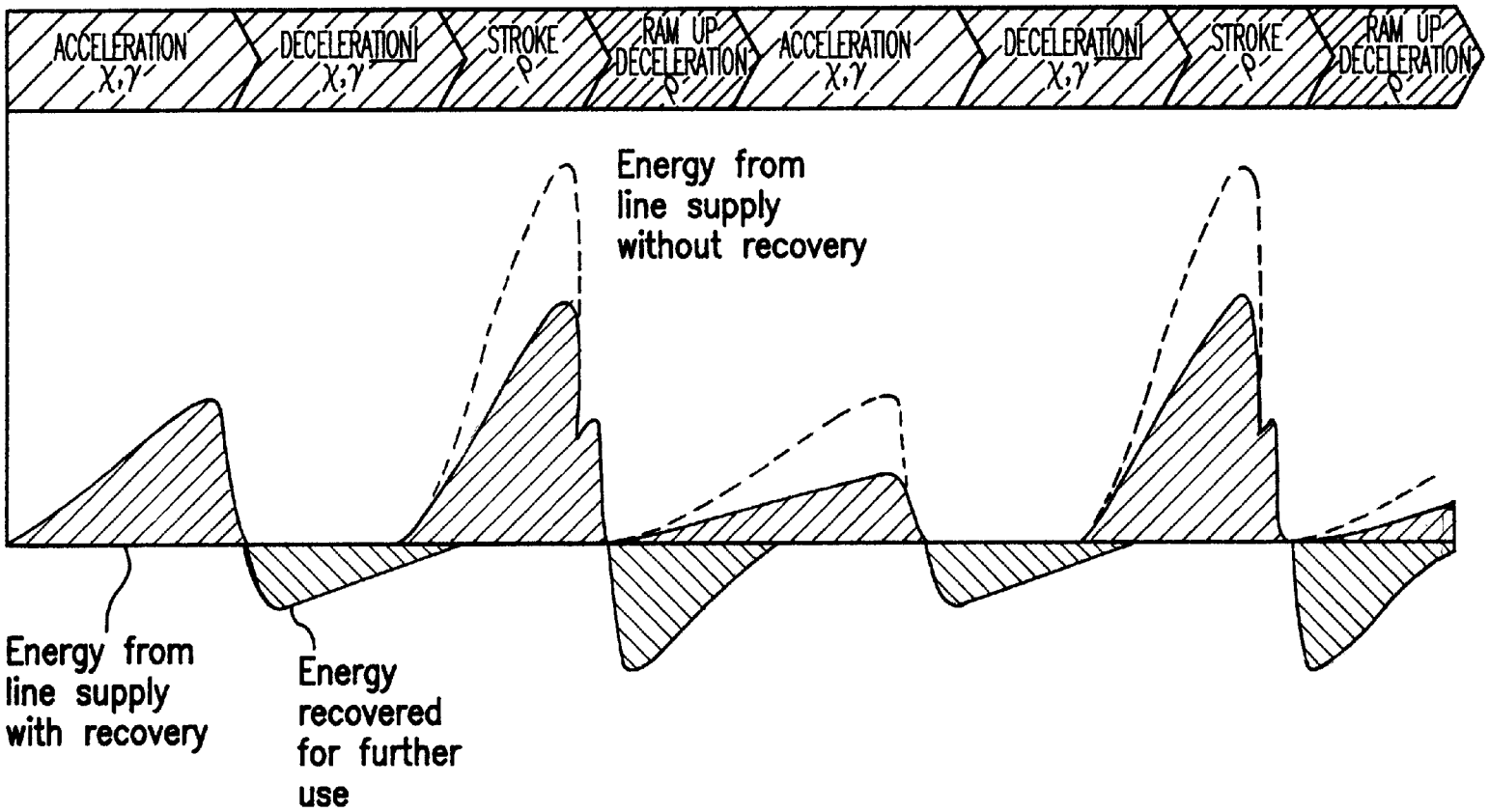
FIG. 27 is a graph illustrating the acceleration/deceleration of the various servo motors and how the excess energy recovered could be used for reducing the energy consumption of the machine of the instant invention.

The energy saving aspect of the sheet fabricating machine of the instant invention is illustrated with FIGS. 26 and 27. As shown in FIG. 26, the energy saving system of the instant invention includes an AC/DC converter 238, which as its name implies accepts 3 phase AC power from the power network and converts this AC power into a DC power to be used by the various servo motors of the machine. Once converted, the DC power is sent to pulse width modulators (PWM) 240 and 242. As should be understood, additional PWMs are used in the instant invention system, insofar as there are more than just the two servo motors being illustrated in FIG. 26 for the sake of simplicity. As shown, PWM 240 is connected to a first servo motor 244, which may for example be the servo motor that drives the movement of the ram, and therefore the tool. The second PWM amplifier 242 has electrically connected thereto a second servo motor 246, which may for example be the servo motor used to drive the worksheet along the x direction. Further shown in the circuit of FIG. 26 are a number of capacitors 248 interconnected between PWM amplifiers 240 and 242.

In operation, when a servo motor begins acceleration, power is input thereto by converter 238. This power is consumed by the servo motor for generating an output torque. When it begins its deceleration phase, as indicated by downward slope 218, the servo motor acts as a generator whereby the deceleration in effect generates excess energy due to the braking function being performed by the servo motor. This excess energy is fed back by the servo motor to its PWM amplifier and then stored in the capacitor 248. And since there are a number of servo motors in the system, there are oftentimes a number of deceleration actions performed by the respective servo motors. The thus stored excess energy in the capacitors can be retrieved by those servo motors that require the use of such excess energy. On the other hand, if the excess energy is not required by the servo motors, it is fed back to converter 238, reconverted to AC, and then fed back to the power network. As a consequence, due to the various servo motors acting as generators during the various deceleration phases, the power consumption of the sheet fabrication machine of the instant invention is much less than that required by conventional sheet fabricating machines.

A graph illustrating the usage of power and the storing of excess energy as well as the use of the recovered energy by other servo motors or components of the system, are illustrated in the graph of FIG. 27. From the dotted lines, note that a substantial amount of energy is saved by the energy saving system of the instant invention machine.

Yet another aspect of the instant invention machine is its ability to monitor its temperature and to automatically provide regulation therefor so that no manufacturing time is lost from overheating of the machine. This feature is illustrated in FIGS. 28*a* and 28*b*, and the procedure for effecting such temperature regulation is illustrated in the flow diagram of FIG. 29.

In particular, with reference to FIGS. 28*a* and 28*b*, note that the temperature of each of the servo motors of the machine is being monitored by the controller of the system, by conventional temperature gauge for example. As has been determined by empirical studies, when the temperature of the servo motor exceeds a given temperature, for example 155° c., it shuts down. Consequently, the operation of the machine ceases. Also, empirical studies indicate that a servo motor would operates efficiently and continuously at a temperature below 120° c. For the instant invention, therefore, the inventors of the instant invention decided to predefine a first temperature limit such as for example 120° c. below which the operation of the machine can continue indefinitely. A second higher temperature, which acts as a warning temperature for example at 140° c., is further defined. Thus, as shown in FIG. 28*b*, so long as the operational temperature of the servo motor continues to be maintained below 120° c., the servo motor can operate indefinitely. However, once the temperature of the servo motor is sensed at 120° c., i.e.,the first temperature limit, then the controller would instruct the servo motor to reduce its acceleration. This is indicated by the downward slope 238. Thus, as the temperature of the servo motor increases to 140° c., the amount of torque being output from the servo motor may in fact be decreased to 30% of its maximum power, which may be the minimum acceleration. At a temperature anywhere over 140° c., a time limit is provided so that if the temperature of the servo motor continues to stay above 140° c. for that period of time, such as for example 2 minutes, then a warning alarm will sound and the system will stop automatically. And if before the time period is up, the temperature of the servo motor reaches a maximum temperature, for example 155° c., to ensure that the system is not damaged, the system automatically shuts down.

With reference to FIGS. 28*b*, note that the acceleration of the servo motor can continue so long as the temperature indicated by line 240 continues to be below 120° c. Anytime that the temperature of the servo motor exceeds 120° c., an instruction is provided by the controller to the servo motor to instruct the servo motor to begin decelerating. With deceleration, the temperature of the servo motor should decrease, as indicated by dotted line 242. Given time, with deceleration, the temperature of the servo motor should once again fall below the limit of 120° c. However, if the temperature of the servo motor continues to increase, as indicated by dotted line 244, then when it reaches a temperature of 140° c., a warning signal is provided to the operator. And after a given time period such as for example the above mentioned 2 minutes, the system shuts down automatically. The temperature of the machine, irrespective of how long it has been above 140° c., so long as it reaches the shut down temperature of 155° c., will automatically shut down to prevent further damage to the machine.

Figure 29A:
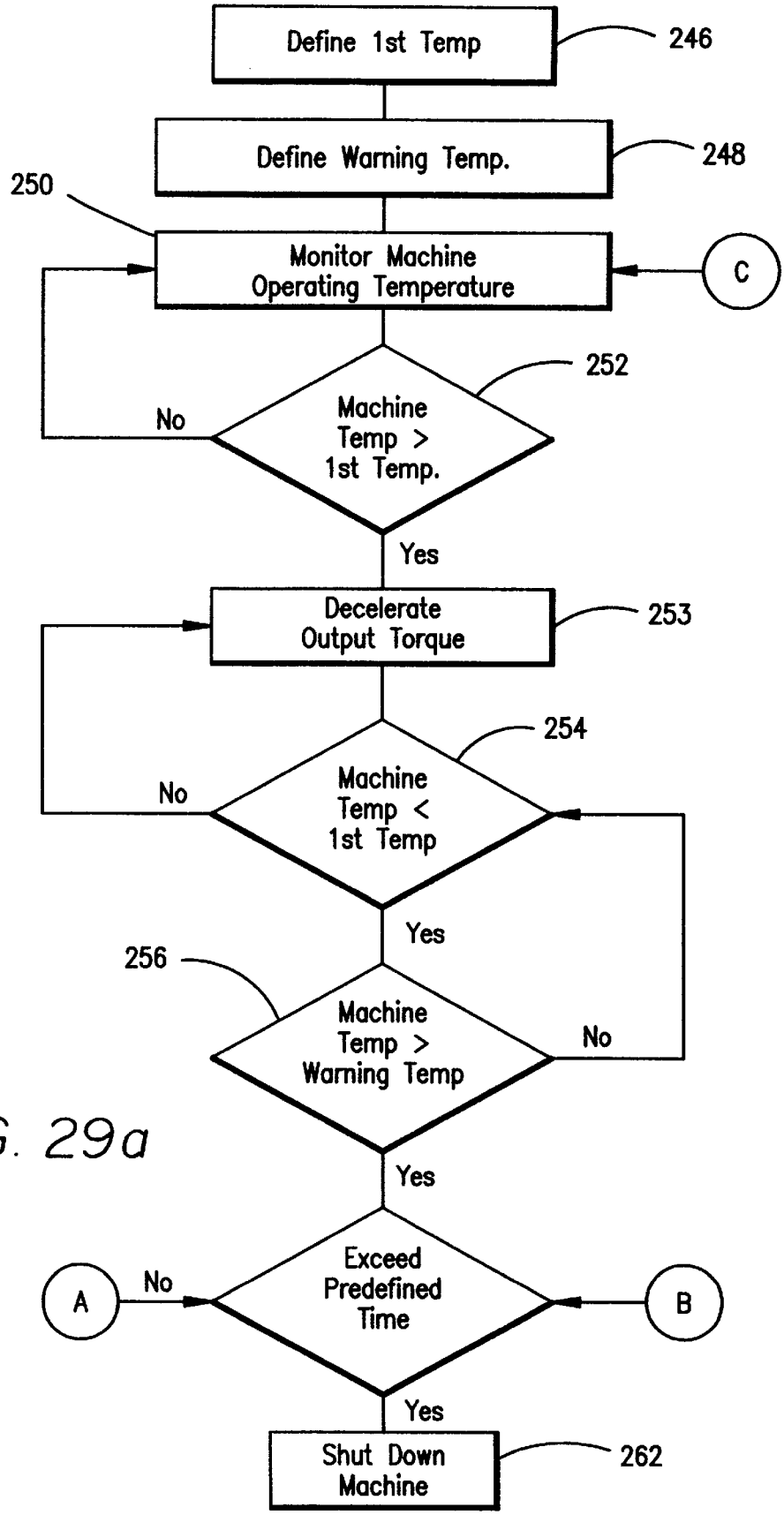
FIG. 29 is a flow chart illustrating the procedure used in the instant machine for maintaining the temperature of the machine of the instant invention to within its operational temperature range.
Figure 29B:
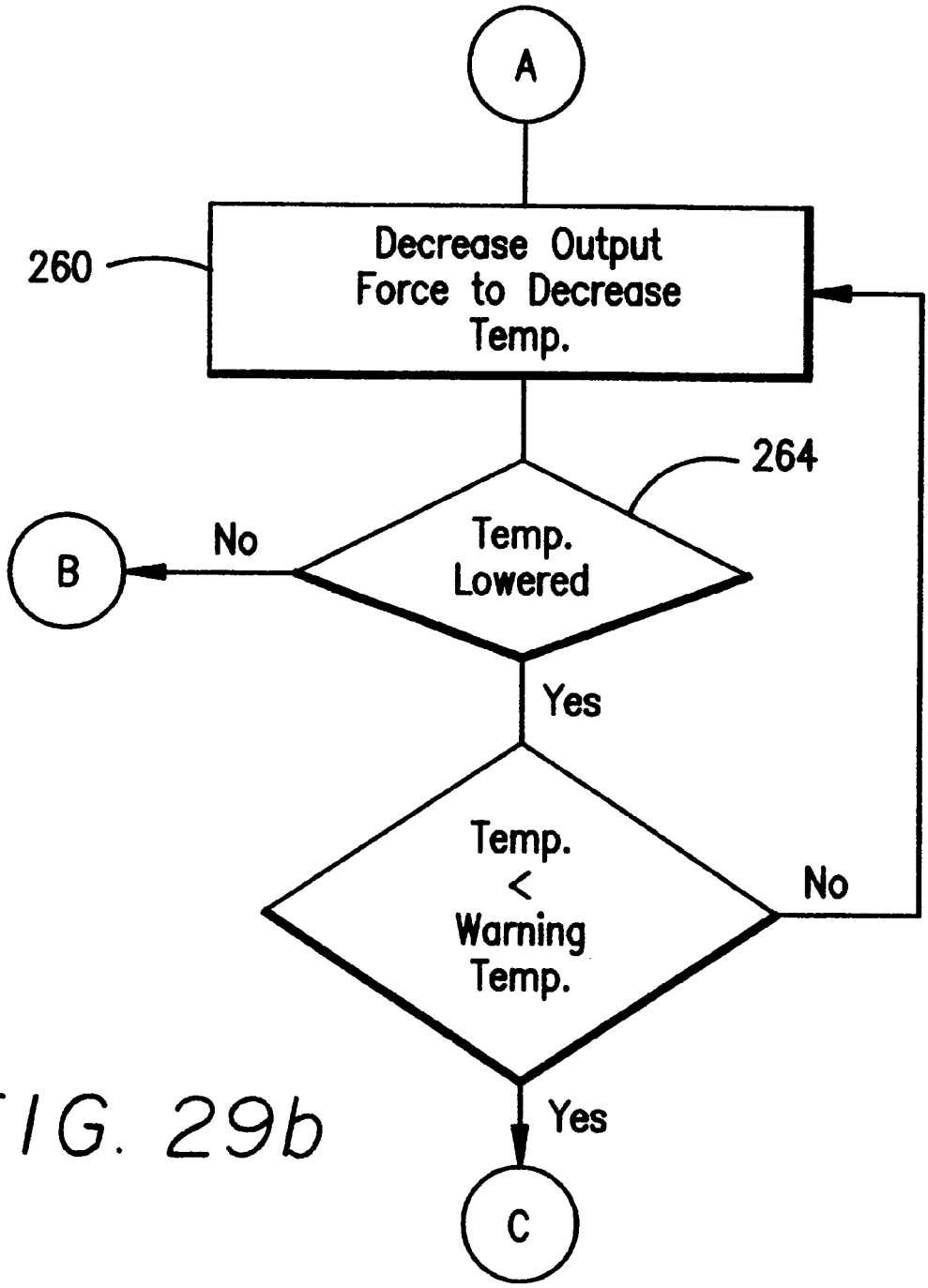

The procedure for monitoring the temperature of the machine of the instant invention, i.e., the various servo motors, is provided in the flow diagram of FIG. 29. As shown, at step 246, a first temperature such as for example 120° c. is defined. A warning temperature such as for example 140° c. is further defined in step 248. The temperature of the machine is monitored per step 250. A determination is then made on whether the temperature has reached the first temperature limit, per step 252. If it has not, the process returns to step 250 to continue to monitor the operating temperature of the machine. If indeed the first temperature is reached, then the process proceeds to step 254, whereby the controller of the system instructs the servo motor to begin to decrease its output torque. Thereafter, a determination is made again on whether the temperature of the machine continues to exceed the first temperature limit. If the temperature of the machine no longer exceeds the first temperature limit per step 254, the process returns to step 250 for continuing to the monitor the operating temperature of the machine.

However, if the first temperature indeed is breached, per step 254, a second determination is made on whether the machine temperature has exceeded the warning temperature, per step 256. If it has not, the process returns to step 250 to continue to maintain the monitoring of the operating temperature of the machine. If indeed the temperature has exceeded the warning temperature, the process proceeds to step 258 to determine whether the temperature of the machine has exceeded the warning temperature for a predefined period of time. If no, then, per step 260, an instruction is sent to the servo motor by the controller to decrease the output torque to thereby lower the temperature of the servo motor. On the other hand, if the predefined time has been exceeded, the machine shuts down per step 262.

Returning to step 260, with the decrease of the output torque, a determination is next made on whether the temperature of the machine indeed has been lowered, per step 264. If it has not been, a determination is made on whether the predefined period of time has been exceeded per step 258. The process then repeats on determining on whether to shut down the machine per step 262, or continue to decrease the output torque of the servo motor to lower its temperature per step 260. If per chance the temperature of the machine has indeed been lowered, yet a further determination is made per step 266, on whether the temperature is less than the warning temperature. If the answer is no, the process returns to step 260 to continue to decrease the acceleration of the servo motor to thereby lower the temperature of the machine. On the other hand, if the temperature is sensed to be less than the warning temperature, the process returns to step 250, to once again begin to monitor the overall operating temperature of the machine.

While a preferred embodiment of the present invention is disclosed herein for purposes of explanation, numerous changes, modifications, variations, substitutions and equivalents in whole or in part, should now be apparent to those skilled in the art to which the invention pertains. Accordingly, it is intended that this invention be limited only by the spirit and scope of the hereto appended claims.

What is claimed is:

1. A method of determining the length of a tool means driven by a servo mechanism means for effecting work on a worksheet along a substantially vertical direction, comprising the steps of:

a) predefining a first distance separating said tool means with a die means;

b) driving said tool means towards said die means until said tool means comes into contact with said die means or a worksheet placed over said die means;

c) determining the force of said servo mechanism means when said tool means contacts said die means or said worksheet; and d) correlating the length of said tool means with said force.

2. Method of claim 1, wherein said servo mechanism means turns a rotating means for driving said tool means, and wherein said step d further comprises the step of:

equating the amount of rotation of said rotating means with said length of said tool means.

3. Method of claim 2, wherein a contact means is coupled to said rotating means, further comprising the step of:

correlating the distance traveled by said contact means along a direction substantially perpendicular to the direction of movement of said tool means with the driven distance of said tool means.

4. Method of claim 3, wherein said contact means comprises a roller, said method further comprising the step of:

configuring a cam at the top of said tool means to have at least two opposed sloping surfaces that meet to form a common uppermost area, said roller coacting with one of said sloping surfaces for driving said tool means towards said die means.

5. Method of claim 3, wherein said contact means comprises a roller, said method further comprising the step of:

configuring a cam at the top of said tool means to have at least one curved surface for coacting with said roller, said roller coacting with said curved surface for driving said tool means towards said die means.

6. Method of claim 1, wherein said tool means comprises a ram, a tool cylinder in alignment with said ram, a stripper means movably coupled to the end of said cylinder, and a tool movably positioned inside said cylinder, said method further comprising the steps of:

predefining a first limit substantially at which there should be a decrease in the force being effected by said servo mechanism means to drive said tool means;

continuing to drive said tool means towards said die means after said tool means has made contact with said die means; and determining said tool within said cylinder to require positional adjustment if the force being effected by said servo mechanism to drive said tool means continues to increase after said first limit is reached.

7. Method of claim 6, further comprising the step of:

effecting the adjustment of said tool within said cylinder by moving said tool closer to said stripper means.

8. Method of claim 1, further comprising the steps of:

storing the value of said force in a memory;

converting the stored value of said force into a value that is representative of the length of said tool means; and displaying said value representative of the length of said tool means.

9. Method of claim 2, wherein said rotating means comprises a threaded drive, and wherein said step b further comprises the step of:

movably coupling a contact means to said threaded drive so that when said servo mechanism means activates, said threaded drive is rotated to move said contact means to drive said tool means.

10. Method of claim 1, further comprising the step of:

coupling said servo mechanism means to means intermediate of said tool means, said servo mechanism driving said intermediate means in a non-vertical direction, said intermediate means coacting with said tool means for driving said tool means in a vertical direction for effecting work on said worksheet.

11. Method of claim 2, wherein said rotating means comprises a threaded drive, said method further comprising the steps of:

electrically coupling an encoder to said servo mechanism means;

monitoring the number of rotations of said threaded drive; and correlating the length of said tool means with the number of rotations of said threaded drive.

12. Method of claim 1, further comprising the steps of:

correlating the thickness of a worksheet by calculating the difference between said force representative of the length of said tool means and a subsequent force exerted by said servo mechanism means for driving said tool means into contact with said worksheet after said worksheet has been placed over said die means.

13. In a sheet fabrication machine, a method of establishing a correct setting for a tool means to effect work against a die means with reference to the correct setting, comprising the steps of:

a) driving said tool means towards said die means until said tool means comes into contact with said die means or a worksheet placed over said die means;

b) determining the force said tool means exerts when it contacts either said die means or said worksheet; and c) utilizing said determined force for defining a setting from which the operation of said tool means is referenced.

14. Method of claim 13, wherein said tool means comprises a ram having a top portion and a tool movable by said ram, said method further comprising the steps of:

activating a servo motor means to drive a contact means to coact with said top portion of said tool means for driving said tool means to contact either said die means or said worksheet;

reading the force output from said servo motor means; and storing said read force in a memory means for use as said setting.

15. Method of claim 14, wherein said top portion includes at least one sloping surface that coacts with said contact means, said servo motor means driving said contact means to coact with said sloping surface for driving said tool means to contact either said die means or said worksheet to define said setting.

16. Method of claim 14, wherein said contact means comprises a roller, said step a further comprising the step of:

activating said servo motor means to drive said roller along a direction substantially perpendicular to the plane of said worksheet to coact with said top portion of said tool means, said top portion converting the direction of said force for driving said tool means towards said die means for effecting work on said worksheet.

17. In a sheet fabrication machine having at least one servo motor means for driving at least one of an upper tool means and a lower tool means, a method of establishing a setting whereby said upper tool means can reference as its base position when it effects work, comprising the steps of:

a) driving said upper tool means and said lower tool means towards each other along a driving direction until said upper tool means comes into contact with either said lower tool means or a worksheet placed between said upper and lower tools;

b) determining the force required to drive said upper tool means to make its first contact with either said lower tool means or said worksheet; and c) utilizing said determined force for defining said setting from which said upper tool means references as its base position.

18. Method of claim 17, wherein said upper tool means comprises a ram having a top portion and a tool movable by said ram, said method further comprising the steps of:

activating said one servo motor means to drive a contact means in a direction not in alignment with said driving direction to coact with said top portion of said upper tool means for driving said tool means to contact either said die means or said worksheet;

reading the force output from said one servo motor means;

storing said read force in a memory means; and using said stored force for defining said setting.

19. Method of claim 18, wherein said top portion includes at least one sloping surface that coacts with said contact means, said one servo motor means driving said contact means to coact with said sloping surface for driving said tool means to contact either said die means or said worksheet to define said setting.

20. Method of claim 18, wherein said contact means comprises a roller, said step a further comprising the step of:

activating said one servo motor means to drive said roller along a direction substantially perpendicular to the plane of said worksheet to coact with said top portion of said tool means, said top portion converting the direction of said force for driving said tool means towards said die means for effecting work on said worksheet.

21. Method of claim 17, wherein said machine further includes an other servo, motor means, said method further comprising the step of:

utilizing said other servo motor means to drive a contact means in a direction not in alignment with said driving direction to coact with said lower tool means so as to drive said lower tool means towards said upper tool means to effect a machining operation on said worksheet.

22. In a sheet fabrication machine having at least one servo motor means for driving at least one of an upper tool means and a lower tool means, a method of establishing a setting whereby said upper tool means can reference as its base position when it effects work, comprising the steps of:

a) driving said upper tool means and said lower tool means towards each other along a driving direction until said upper tool means comes into contact with either said lower tool means or a worksheet placed between said upper and lower tools;

b) determining the distance traversed by said upper tool means to make its first contact with either said lower tool means or said worksheet; and c) utilizing said determined distance for defining said setting from which said upper tool means references as its base position.

23. Method of claim 22, wherein said upper tool means comprises a ram having a top portion and a tool movable by said ram, said method further comprising the steps of:

activating said one servo motor means to drive a contact means in a direction not in alignment with said driving direction to coact with said top portion of said upper tool means for driving said tool means to contact either said die means or said worksheet;

reading the force output from said one servo motor means;

equating said force with said determined distance;

storing said determined distance in a memory means; and using said stored determined distance for defining said setting.

24. Method of claim 23, wherein said top portion includes at least one sloping surface that coacts with said contact means, said one servo motor means driving said contact means to coact with said sloping surface for driving said tool means to contact either said die means or said worksheet to define said setting.

25. Method of claim 23, wherein said contact means comprises a roller, said step a further comprising the step of:

activating said one servo motor means to drive said roller along a direction substantially perpendicular to the plane of said worksheet to coact with said top portion of said tool means, said top portion converting the direction of said force for driving said tool means towards said die means for effecting work on said worksheet.

26. Method of claim 22, wherein said machine further includes an other servo motor means, said method further comprising the step of:

utilizing said other servo motor means to drive a contact means in a direction not in alignment with said driving direction to coact with said lower tool means so as to drive said lower tool means towards said upper tool means to effect a machining operation on said worksheet.

* * * * *